US010310408B2

(12) United States Patent
Tsujihara

(10) Patent No.: US 10,310,408 B2
(45) Date of Patent: Jun. 4, 2019

(54) IMAGE FORMING APPARATUS AND METHOD FOR DETERMINING USABLE PERIOD OF CLEANER USED FOR IMAGE FORMING OPERATIONS

(71) Applicant: Konica Minolta, Inc., Chiyoda-ku, Tokyo (JP)

(72) Inventor: Momoko Tsujihara, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/919,616

(22) Filed: Mar. 13, 2018

(65) Prior Publication Data

US 2018/0267457 A1 Sep. 20, 2018

(30) Foreign Application Priority Data

Mar. 17, 2017 (JP) ..... 2017-052651

(51) Int. Cl.

| | |
|---|---|
| ***G03G 15/08*** | (2006.01) |
| ***G03G 21/00*** | (2006.01) |
| ***G03G 15/06*** | (2006.01) |
| ***G03G 15/00*** | (2006.01) |

(52) U.S. Cl.

CPC ..... *G03G 15/0848* (2013.01); *G03G 15/06* (2013.01); *G03G 15/553* (2013.01); *G03G 21/0011* (2013.01); *G03G 21/0064* (2013.01)

(58) Field of Classification Search

CPC ..... G03G 15/0848; G03G 15/553; G03G 15/556; G03G 21/169; G03G 2221/1618

USPC ..... 399/29, 111, 123, 350

See application file for complete search history.

(56) References Cited

U.S. PATENT DOCUMENTS

| | | | | |
|---|---|---|---|---|
| 6,473,572 | B1 * | 10/2002 | Uchiyama | G03G 21/1889 399/24 |
| 8,190,037 | B2 * | 5/2012 | Nakazato | G03G 15/5079 399/9 |
| 2003/0118383 | A1 * | 6/2003 | Endo | G03G 9/0819 399/350 |
| 2008/0199193 | A1 * | 8/2008 | Nakazato | G03G 15/01 399/49 |
| 2009/0322524 | A1 * | 12/2009 | Nakazato | G03G 15/553 340/540 |
| 2011/0255883 | A1 * | 10/2011 | Fukuda | G03G 15/0896 399/24 |

FOREIGN PATENT DOCUMENTS

| | | | |
|---|---|---|---|
| JP | 2004-004544 | A | 1/2004 |
| JP | 2005-178058 | A | 7/2005 |
| JP | 2006-047330 | A | 2/2006 |
| JP | 2009-288481 | A | 12/2009 |
| JP | 2010217555 | A * | 9/2010 |
| JP | 2014026212 | A * | 2/2014 |

* cited by examiner

*Primary Examiner* — Robert B Beatty
(74) *Attorney, Agent, or Firm* — Buchanan Ingersoll & Rooney PC

(57) ABSTRACT

An image forming apparatus determines the replacement timing of a component of the image forming apparatus and includes: a rotatable body; a cleaner to remove developer adhered to the rotatable body; and a controller determining that a usable period of the cleaner is longer as a charge amount of the developer is smaller.

17 Claims, 19 Drawing Sheets

300

PRIOR ART

〈FOR LOW COVERAGE RATE〉

〈FOR HIGH COVERAGE RATE〉

300

IMAGE FORMING APPARATUS AND METHOD FOR DETERMINING USABLE PERIOD OF CLEANER USED FOR IMAGE FORMING OPERATIONS

The entire disclosure of Japanese Patent Application No. 2017-052651 filed on Mar. 17, 2017 is incorporated herein by reference in its entirety.

BACKGROUND

Technological Field

The present disclosure relates to image forming apparatuses, and more specifically relates to a technique for determining the replacement timing of a component of an image forming apparatus.

Description of the Related Art

Generally, the usable period of a product or a component of a product is estimated to be shorter in order to guarantee the performance of the product even under harsh environments. Moreover, a technique for preventing replacement of a product or a component of a product that is actually still usable, i.e., a technique for improving the precision in predicting the replacement timing of a product or a component of a product, has been in demand. For image forming apparatuses, such a technique has been in strong demand.

Regarding the technique for improving the precision in predicting the replacement timing of a component of an image forming apparatus, Japanese Laid-Open Patent Publication No. 2005-178058 for example discloses an image forming apparatus "acquiring, from a wireless IC tag attached to a process cartridge, information about the date of manufacture, the date of installation, the deterioration factor, and the threshold limit value, calculating the pre-installation degree of deterioration representing deterioration in the packaged state, the pre-operation degree of deterioration representing deterioration in the non-operating state after installation, and the in-operation degree of deterioration representing deterioration in the operating state, and comparing the total degree of deterioration that is the sum of these degrees of deterioration with the threshold limit value to thereby calculate the shelf life" (see "Abstract").

Japanese Laid-Open Patent Publication No. 2004-004544 discloses an image forming apparatus "performing control such that the cleaner-abutting pressure in a second operation is higher than that in a first operation, where the first operation removes developer remaining on a first image bearing member upon transfer of a developer image to a transfer material, and the second operation removes the developer image on the first image bearing member that has not been transferred to a second image bearing member" (see "Abstract").

Japanese Laid-Open Patent Publication No. 2009-288481 relates to a technique for preventing a toner image from slipping through a cleaning blade, and discloses an image forming apparatus in which "toner with older date of manufacture, which has deteriorated chargeability and thus deteriorated electrostatic suction to an intermediate transfer belt, is used in a larger amount to form a discharged-toner image so that the discharged-toner image is small in charge amount and less likely to slip through the cleaning blade" (see "Abstract").

Japanese Laid-Open Patent Publication No. 2006-047330 discloses a technique for setting a different usable period (number of printable pages) for each member or device that is a component of an image forming apparatus.

SUMMARY

A variety of techniques have been proposed for improving the precision in predicting the replacement timing of a component of an image forming apparatus as described above. Recent environmental issues and the like, however, lead to demand for further improvement of the precision in prediction. Essentially Japanese Laid-Open Patent Publication No. 2009-288481 does not aim to improve the precision in predicting the timing of replacing a component.

The present disclosure is given for providing solutions to the above problem, and an object in an aspect is to provide a technique for improving the precision in predicting the replacement timing of a component of an image forming apparatus, relative to the conventional image forming apparatus.

To achieve at least one of the abovementioned objects, according to an aspect of the present invention, an image forming apparatus reflecting one aspect of the present invention includes: a rotatable body; a cleaner to remove developer adhered to the rotatable body; and a controller configured to determine that a usable period of the cleaner is longer as a charge amount of the developer is smaller.

Preferably, the image forming apparatus further includes: a developing device to develop an electrostatic latent image formed on a photoconductor by the developer; and a density sensor to detect a density of a patch image developed by the developing device. The controller is configured to determine that the charge amount of the developer is smaller as the density of the patch image detected by the density sensor is higher.

Preferably, the image forming apparatus further includes: a developing device to develop an electrostatic latent image formed on a photoconductor by the developer; and a density sensor to detect a density of a patch image developed by the developing device. The controller is configured to determine that the charge amount of the developer is smaller as a developing bias applied to the developing device is smaller. The developing bias is set based on the density of the patch image detected by the density sensor.

Preferably, the controller is configured to determine that the usable period of the cleaner has expired, when the charge amount of the developer is larger than a predetermined value.

Preferably, the controller is configured to determine the usable period of the cleaner after a count value reaches a predetermined value. The count value is incremented as printing is performed. The count value is initialized when the cleaner is replaced.

More preferably, the image forming apparatus further includes: a developing device to develop an electrostatic latent image formed on a photoconductor by the developer; and a density sensor to detect a density of a patch image developed by the developing device. The controller is configured to determine that the usable period of the cleaner has expired, when the density of the patch image detected by the density sensor is a predetermined value or less.

More preferably, the image forming apparatus further includes: a developing device to develop an electrostatic latent image formed on a photoconductor by the developer; and a density sensor to detect a density of a patch image developed by the developing device. The controller is configured to determine that the usable period of the cleaner has expired, when a developing bias applied to the developing device is a predetermined value or more. The developing bias is set based on the density of the patch image detected by the density sensor.

Preferably, the image forming apparatus further includes a developing device to develop an electrostatic latent image formed on a photoconductor by the developer. The cleaner is replaceable independently of the developing device. The controller is configured to determine that the usable period of the cleaner is longer as the number of the cleaners replaced for the same developing device is larger.

More preferably, the controller is configured to set a pressure smaller as the number of the cleaners replaced for the same developing device is larger. The pressure is applied to press the cleaner against the rotatable body.

Preferably, the controller is configured to determine that the usable period of the cleaner has expired, when a count value reaches a predetermined value. The count value is incremented as printing is performed. The predetermined value is set larger as the number of the cleaners replaced for the same developing device is larger. The count value is initialized when the cleaner is replaced.

More preferably, the controller is configured to set the predetermined value larger as a coverage rate is higher.

More preferably, the controller is configured to set the predetermined value larger as an average value of the number of pages printed per print job is larger.

Preferably, the controller is configured to determine that the usable period of the cleaner has expired, when the count value reaches the predetermined value and the controller determines that a usable period of the developing device has expired.

Preferably, the rotatable body includes at least one of a photoconductor, an intermediate transfer belt, or a secondary transfer roller.

According to another aspect, there is provided an image forming system including an image forming apparatus and a server apparatus. The image forming apparatus includes: a rotatable body; a cleaner to remove developer adhered to the rotatable body; an acquisition unit to acquire a charge amount of the developer; and a communication interface to transmit a result of acquisition by the acquisition unit to the server apparatus. The server apparatus is configured to determine that a usable period of the cleaner is longer as the charge amount of the developer is smaller, based on the result of acquisition.

According to a further aspect, there is provided a method for determining a usable period of a cleaner used for an image forming apparatus. The method includes: acquiring a charge amount of developer used for the image forming apparatus; and determining that the usable period of the cleaner is longer as the acquired charge amount of the developer is smaller.

According to a still further aspect, there is provided a non-transitory computer-readable recording medium storing a determination program to be executed by a computer of an image forming apparatus for determining a usable period of a cleaner used for the image forming apparatus. The determination program causes the computer to perform: acquiring a charge amount of developer used for the image forming apparatus; and determining that the usable period of the cleaner is longer as the acquired charge amount of the developer is smaller.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
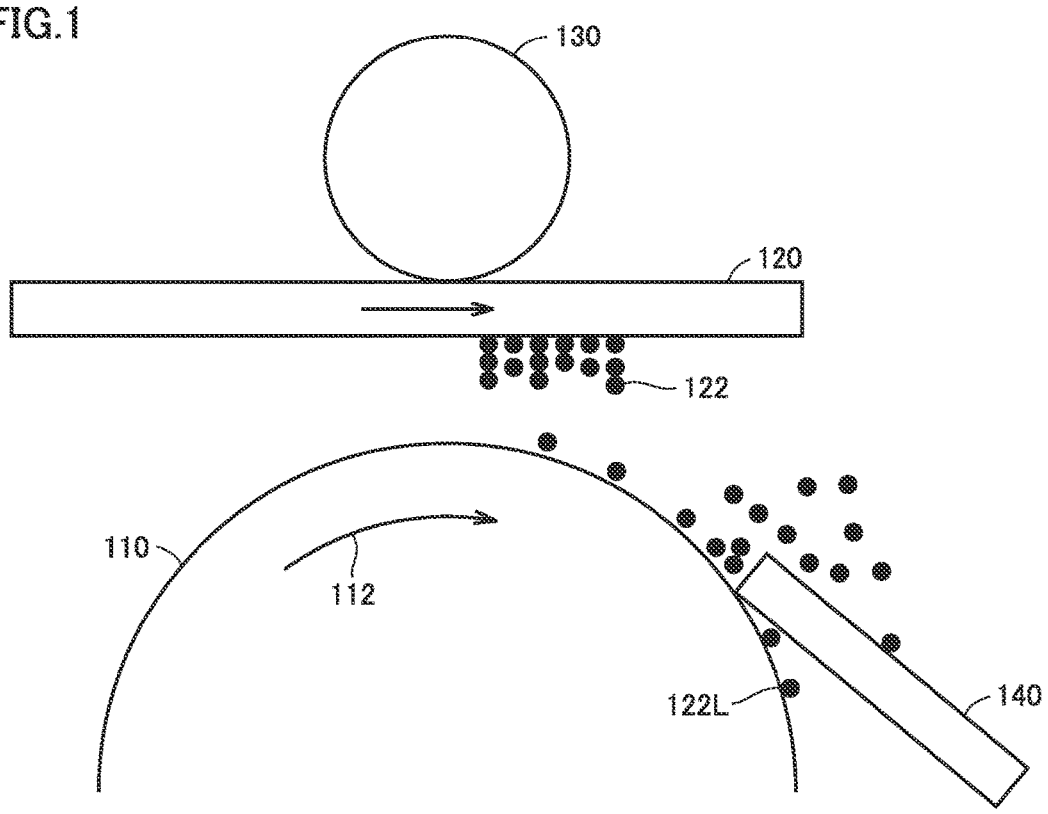
FIG. 1 is a diagram illustrating how toner remaining on a surface of a photoconductor is collected.

Hereinafter, one or more embodiments of the present invention will be described with reference to the drawings. However, the scope of the invention is not limited to the disclosed embodiments.

In the following, embodiments of the technological concept are described in detail with reference to the drawings. In the following description, the same parts are denoted by the same reference characters. They are named identically and function identically. The detailed description thereof is therefore not repeated. Embodiments and modifications described below may be selectively combined as appropriate.

Technological Concept

Figure 2:
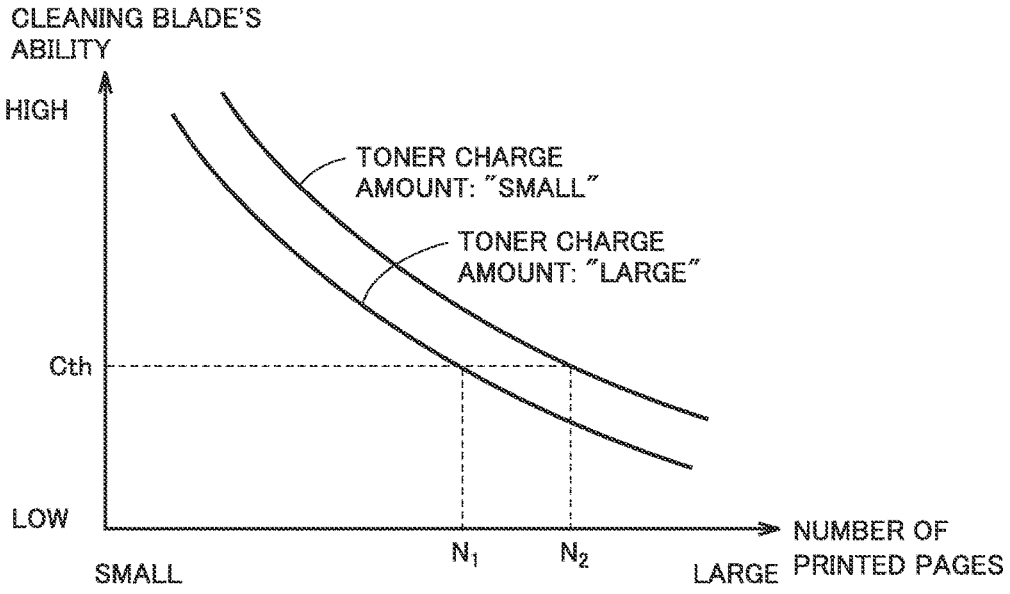
FIG. 2 shows a relation between the number of printed pages and the cleaning blade's ability for each of a small toner charge amount and a large toner charge amount.

With reference to FIGS. 1 and 2, a description is given of an overview of control for an image forming apparatus according to embodiments. FIG. 1 illustrates how toner remaining on the surface of a photoconductor 110 is collected. With reference to FIG. 1, the image forming apparatus based on electrophotography includes photoconductor 110, an intermediate transfer belt 120, a primary transfer roller 130, and a cleaning blade 140.

Photoconductor 110 is supplied with toner 122 which is developer from a developing device (not shown). A toner image formed on photoconductor 110 is transferred to intermediate transfer belt 120 by the action of electric field formed between photoconductor 110 and primary transfer roller 130.

All the toner 122 formed on the surface of photoconductor 110 is not transferred to intermediate transfer belt 120. Toner remaining on the surface of photoconductor 110 is a factor causing an image defect (stripes in the image, for example). Cleaning blade 140 therefore collects the remaining toner from the surface of photoconductor 110.

Generally, cleaning blade 140 is made of rubber, and the blade's ability to collect remaining toner from the surface of photoconductor 110 deteriorates due to wear resultant from contact with the photoconductor and/or any change of the material. As a result of this, the amount of slip-through toner 122L that has not been collected by cleaning blade 140 increases. When the amount of slip-through toner 122L exceeds a predetermined amount, an image defect that is visually recognizable by a user is generated.

FIG. 2 shows a relation between the number of printed pages and the cleaning blade's ability for each of a small toner charge amount and a large toner charge amount. The ability of cleaning blade 140 is represented by the ratio of the toner amount collectable by cleaning blade 140 to the amount of toner remaining on the surface of photoconductor 110. As described above, the ability of cleaning blade 140 lowers gradually with increase of the total number of printed pages. When the ability of cleaning blade 140 becomes equal to or lower than a threshold ability Cth, an image defect visually recognizable by a user is generated. Cleaning blade 140 whose ability becomes equal to or less than threshold ability Cth is therefore replaced.

The ability of cleaning blade 140 is higher as the charge amount of toner 122 is smaller. This is because of smaller electrostatic interaction between toner 122 and photoconductor 110. Therefore, the number of printed pages $N_2$ at which the ability of cleaning blade 140 reaches threshold ability Cth for the smaller toner charge amount is larger than the number of printed pages $N_1$ at which the ability of cleaning blade 140 reaches threshold ability Cth for the larger toner charge amount.

The image forming apparatus according to the embodiments makes use of this characteristic to acquire the toner charge amount directly or indirectly and, as the toner charge amount is smaller, the image forming apparatus determines that the period for which the cleaning blade is usable (hereinafter also referred to as "usable period") is longer. For example, when the acquired toner charge amount is less than a predetermined charge amount, the image forming apparatus determines that the cleaning blade is still usable. The image forming apparatus according to the embodiments configured in the above-described manner enables increase of the precision in predicting the replacement timing of the cleaning blade, as compared with the conventional image forming apparatus. Accordingly, the cleaning blade is usable for a longer period than the conventional one. In the case where the cleaning blade forms a unit together with another component(s) (photoconductor, for example), the image forming apparatus according to the embodiments enables increase of the usable period of the unit including the cleaning blade. In the following, a description is given of a specific configuration of and control for the image forming apparatus according to the embodiments.

First Embodiment

External Configuration of Image Forming Apparatus

Figure 3:
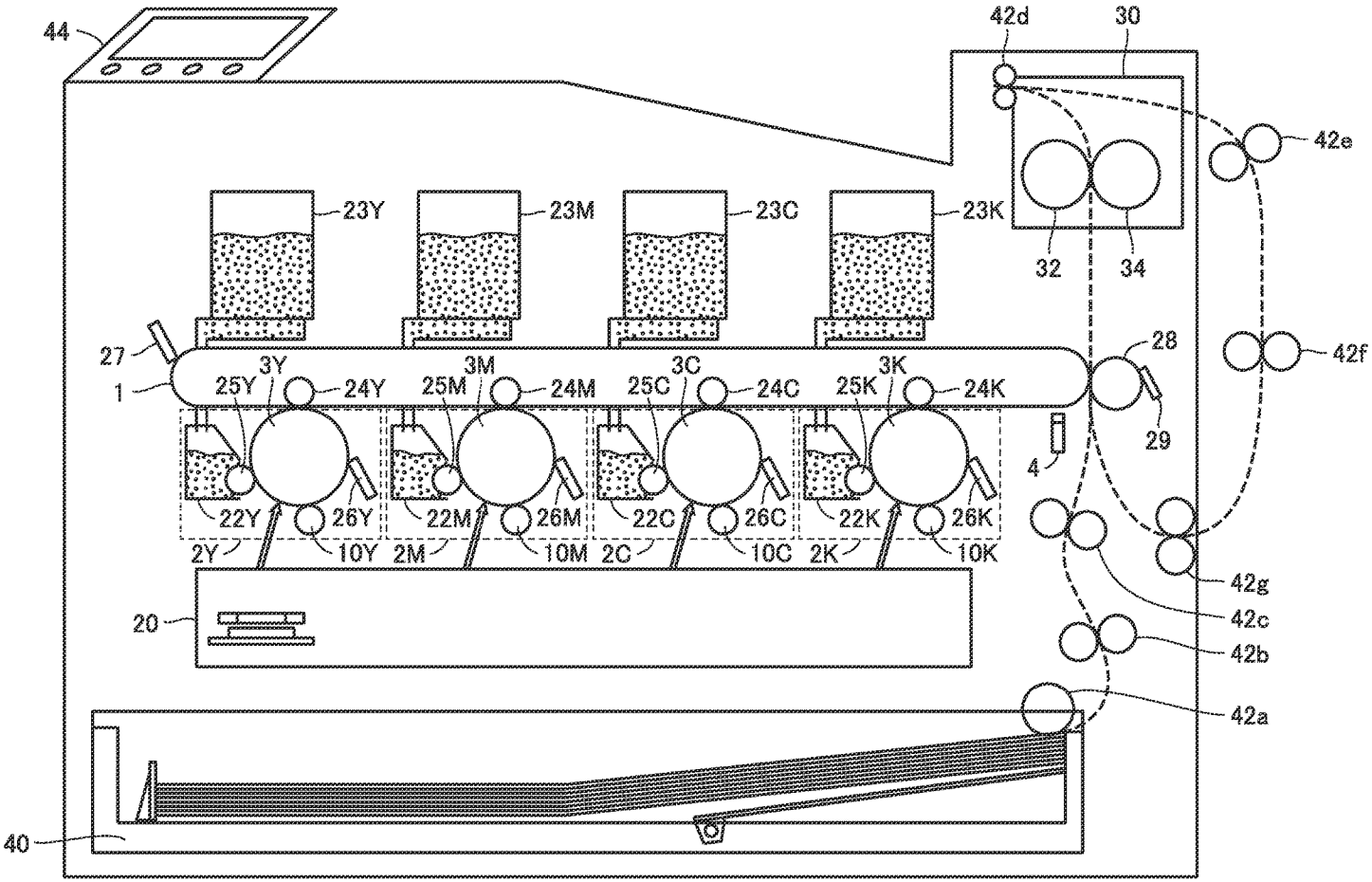
FIG. 3 is a diagram illustrating an example of an external configuration of an image forming apparatus according to a first embodiment.

FIG. 3 is a diagram illustrating an example of an external configuration of an image forming apparatus 300 according to a first embodiment. Image forming apparatus 300 is an electrophotographic image forming apparatus such as laser printer or LED printer, and forms an image on a medium such as a sheet of paper based on an input image signal. As shown in FIG. 3, image forming apparatus 300 includes an intermediate transfer belt 1 as a belt member at a substantially central portion in the image forming apparatus. Under a lower horizontal portion of intermediate transfer belt 1, four imaging units 2Y, 2M, 2C, 2K corresponding respectively to the colors: yellow (Y), magenta (M), cyan (C), black (K) are arranged along intermediate transfer belt 1, and these units have photoconductors 3Y, 3M, 3C, 3K, respectively. Each of imaging units 2Y, 2M, 2C, 2K is configured to be replaceable. Photoconductors 3Y, 3M, 3C, 3K for carrying and transporting a latent image each develop a toner image on a photoconductor film formed on the outer periphery of the photoconductor. The toner image is to be transferred to a medium such as a sheet of paper.

Around photoconductors 3Y, 3M, 3C, 3K, the following components are arranged in order in the rotational direction of the photoconductors. The components are: charging rollers 10Y, 10M, 10C, 10K, a laser unit 20, developing devices 22Y, 22M, 22C, 22K, primary transfer rollers 24Y, 24M, 24C, 24K that face respective photoconductors 3Y, 3M, 3C, 3K with intermediate transfer belt 1 interposed between the photoconductor and the primary transfer roller, and cleaning blades 26Y, 26M, 26C, 26K. Developing devices 22Y, 22M, 22C, 22K include developing rollers 25Y, 25M, 25C, 25K, respectively. Cleaning blades 26Y, 26M, 26C, 26K are pressed against photoconductors 3Y, 3M, 3C, 3K respectively by a pressing mechanism (not shown).

To developing devices 22Y, 22M, 22C, 22K, toner bottles 23Y, 23M, 23C, 23K are connected, respectively. A cleaning blade 27 is pressed against intermediate transfer belt 1 by a pressing mechanism (not shown). A density sensor 4 is disposed between imaging unit 2K and a secondary transfer region on the most downstream side of intermediate transfer belt 1.

A secondary transfer roller 28 is pressed against intermediate transfer belt 1. In this region, secondary transfer is performed. A cleaning blade 29 is pressed against secondary transfer roller 28 by a pressing mechanism (not shown). A fixing device 30 including a fixing roller 32 and a pressure roller 34 is arranged downstream of a transport path located behind the secondary transfer region.

In a lower portion of image forming apparatus 300, a paper feed cassette 40 is removably disposed. Sheets of paper stacked and contained in paper feed cassette 40 are fed one by one from the top sheet to the transport path by rotation of a transport roller 42*a*. On the transport path, transport roller pairs 42*b*, 42*c*, 42*d*, 42*e*, 42*f*, 42*g* are arranged. Moreover, in an upper portion of image forming apparatus 300, an operation panel 44 is disposed. For example, operation panel 44 is made up of a display and buttons for receiving user's input.

While image forming apparatus 300 in the present embodiment uses the tandem intermediate transfer system by way of example, the image forming apparatus is not limited to this. The image forming apparatus may use the cycle system or the direct transfer system by which toner is directly transferred from a developing device to a printing medium. Alternatively, the image forming apparatus may be a multifunction device incorporating functions such as copier, printer, and facsimile functions.

General Operation of Image Forming Apparatus

Next, a general operation of image forming apparatus 300 configured in the above-described manner is described. Upon input of an image signal from an external device (such as personal computer for example) to image forming apparatus 300, image forming apparatus 300 generates a digital image signal by color conversion of the input image signal to yellow, magenta, cyan, black. Based on the generated digital image signal, image forming apparatus 300 causes laser unit 20 to emit light so as to perform exposure.

Accordingly, an electrostatic latent image formed on each of photoconductors 3Y, 3M, 3C, 3K is developed by toner supplied from a corresponding one of developing devices 22Y, 22M, 22C, 22K to generate a toner image of each color. When the amount of toner in each of developing devices 22Y, 22M, 22C, 22K decreases, toner is supplied from corresponding toner bottles 23Y, 23M, 23C, 23K.

Toner images of respective colors are successively laid on one another on intermediate transfer belt 1 by the action of primary transfer rollers 24Y, 24M, 24C, 24K. Primary transfer is thus accomplished. After the primary transfer, toner remaining on each photoconductor 3Y, 3M, 3C, 3K is collected by corresponding cleaning blade 26Y, 26M, 26C, 26K.

The toner images thus formed on intermediate transfer belt 1 undergo secondary transfer all together onto a sheet of paper by the action of secondary transfer roller 28. Toner remaining on intermediate transfer belt 1 is collected by cleaning blade 27.

The toner image which is secondary-transferred to the sheet of paper reaches fixing device 30. The toner image is fixed on the sheet of paper by the action of heated fixing roller 32 and pressure roller 34. Toner remaining on secondary transfer roller 28 is collected by cleaning blade 29. The paper on which the toner image is fixed is discharged through transport roller pair 42*d* to a copy receiving tray.

When images are to be formed on both sides of a sheet of paper, transport roller pair 42*d* is rotated in the opposite direction after the sheet of paper has passed through fixing device 30, and the sheet of paper is transported again by transport roller pairs 42*e*, 42*f*, and 42*g* to the secondary transfer region. In this way, the above-described secondary transfer and fixing for the sheet of paper are performed. After this, the paper is discharged by transport roller pair 42*d* to the copy receiving tray.

In the following, the characters: yellow "Y," magenta "M," cyan "C," and black "K" may not be used for reference characters for devices. Such a device represents respective devices for the four colors. For example, photoconductor 3 represents photoconductors 3Y, 3M, 3C, 3K.

Electrical Configuration of Image Forming Apparatus

Figure 4:
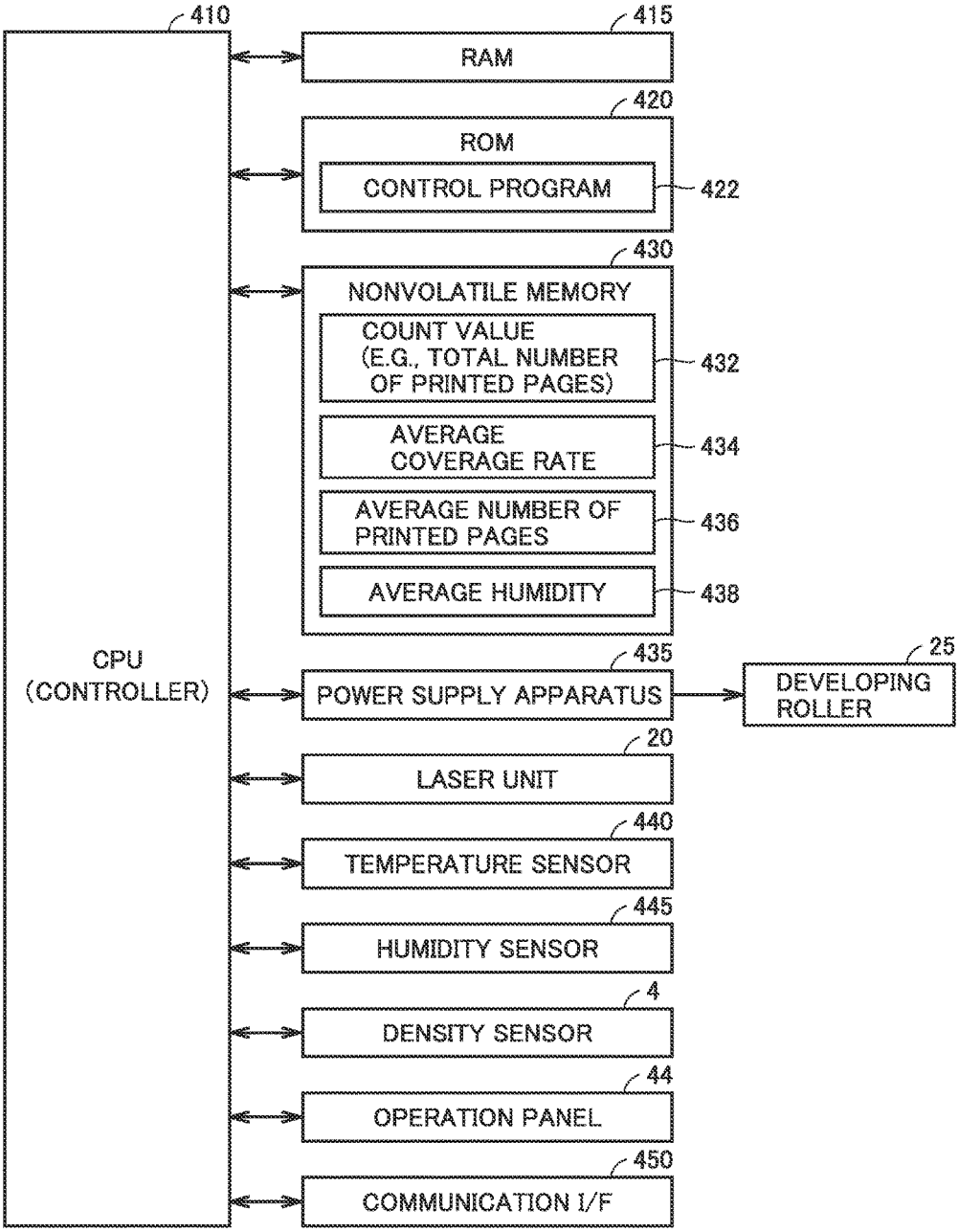
FIG. 4 is a diagram illustrating an example of an electrical configuration of the image forming apparatus according to the first embodiment.

FIG. 4 is a diagram illustrating an example of an electrical configuration of image forming apparatus 300 according to the first embodiment. Image forming apparatus 300 includes a CPU (Central Processing Unit) 410 functioning as a controller for image forming apparatus 300. CPU 410 is electrically connected to each of a RAM (Random Access Memory) 415, a ROM (Read Only Memory) 420, a nonvolatile memory 430, a power supply apparatus 435, laser unit 20, a temperature sensor 440, a humidity sensor 445, density sensor 4, operation panel 44, and a communication interface (I/F) 450. CPU 410 reads and executes a control program 422 stored in ROM 420 to thereby control operation of each device connected to CPU 410.

RAM 415 functions as a working memory for CPU 410 to execute control program 422. Nonvolatile memory 430 stores a count value 432, an average coverage rate 434, an average number of printed pages 436, and an average humidity 438.

Count value 432 is a value incremented as printing is performed. CPU 410 stores, in nonvolatile memory 430, count value 432 for each of the colors Y, M, C, and K as well as count value 432 for cleaning blades 27 and 29. For example, count value 432 for yellow includes the total number of printed pages printed with yellow toner, the travel distance of photoconductor 3Y, and the number of rotations of photoconductor 3Y. For example, count value 432 of cleaning blade 27 includes the total number of printed pages for which cleaning blade 27 is used, the travel distance of intermediate transfer belt 1, and the number of rotations of intermediate transfer belt 1. When CPU 410 detects replacement of any cleaning blade or any unit including a cleaning blade, CPU 410 initializes the corresponding count value (sets the count value to zero).

Based on an input image signal, CPU 410 calculates the coverage rate. The coverage rate is the rate of a printed area to a printable area. Average coverage rate 434 is an average value of the coverage rate. Average number of printed pages 436 is an average value of the number of printed pages included in a print job. Average humidity 438 is an average value of the relative humidity detected by humidity sensor 445. In an aspect, average humidity 438 is an average value of the relative humidity detected by humidity sensor 445 each time a print job is input. In another aspect, average humidity 438 is an average value of the absolute humidity calculated from the temperature detected by temperature sensor 440 and the relative humidity detected by humidity sensor 445.

CPU 410 stores, in nonvolatile memory 430, average coverage rate 434, average number of printed pages 436, and average humidity 438 for each of the colors Y, M, C, and K. When CPU 410 detects replacement of a cleaning blade or a unit including a cleaning blade, CPU 410 initializes (sets to zero) average coverage rate 434, average number of printed pages 436, and average humidity 438 of a corresponding color.

Power supply apparatus 435 applies a negative developing bias voltage to developing roller 25 based on an instruction from CPU 410. Toner carried and transported by developing roller 25 is adhered to an exposed portion of photoconductor 3 based on a potential difference between developing roller 25 and exposed photoconductor 3.

Temperature sensor 440 measures the temperature in image forming apparatus 300 and outputs the result of the measurement to CPU 410. Temperature sensor 440 may be of contact type or non-contact type. For example, temperature sensor 440 is implemented by a thermocouple.

Humidity sensor 445 measures the humidity in image forming apparatus 300 and outputs the result of the measurement to CPU 410. Humidity sensor 445 may be polymer capacitive humidity sensor or polymer resistive humidity sensor.

Density sensor 4 detects the density of a toner image formed on intermediate transfer belt 1. For example, density sensor 4 includes a light emitting device (not shown) emitting light, and a light receiving device (not shown) receiving the light emitted from the light emitting device and reflected. As intermediate transfer belt 1 is irradiated with light emitted from the light emitting device, the light receiving device detects the light reflected from the toner image on intermediate transfer belt 1. Density sensor 4 outputs, to CPU 410, the amount of photocurrent (detected voltage) generated at the light receiving device.

Communication I/F 450 is implemented by a wireless LAN (Local Area Network) card, for example. Image forming apparatus 300 is configured to be capable of communicating with external devices (such as personal computer, smart phone, tablet, and server) connected to a LAN or WAN (Wide Area Network) via communication interface 450.

In connection with the first to fourth embodiments described below, a description is given of a process for determining whether the usable period of cleaning blade 26Y has expired or not, for the sake of facilitating understanding.

Control Structure

Figure 5:
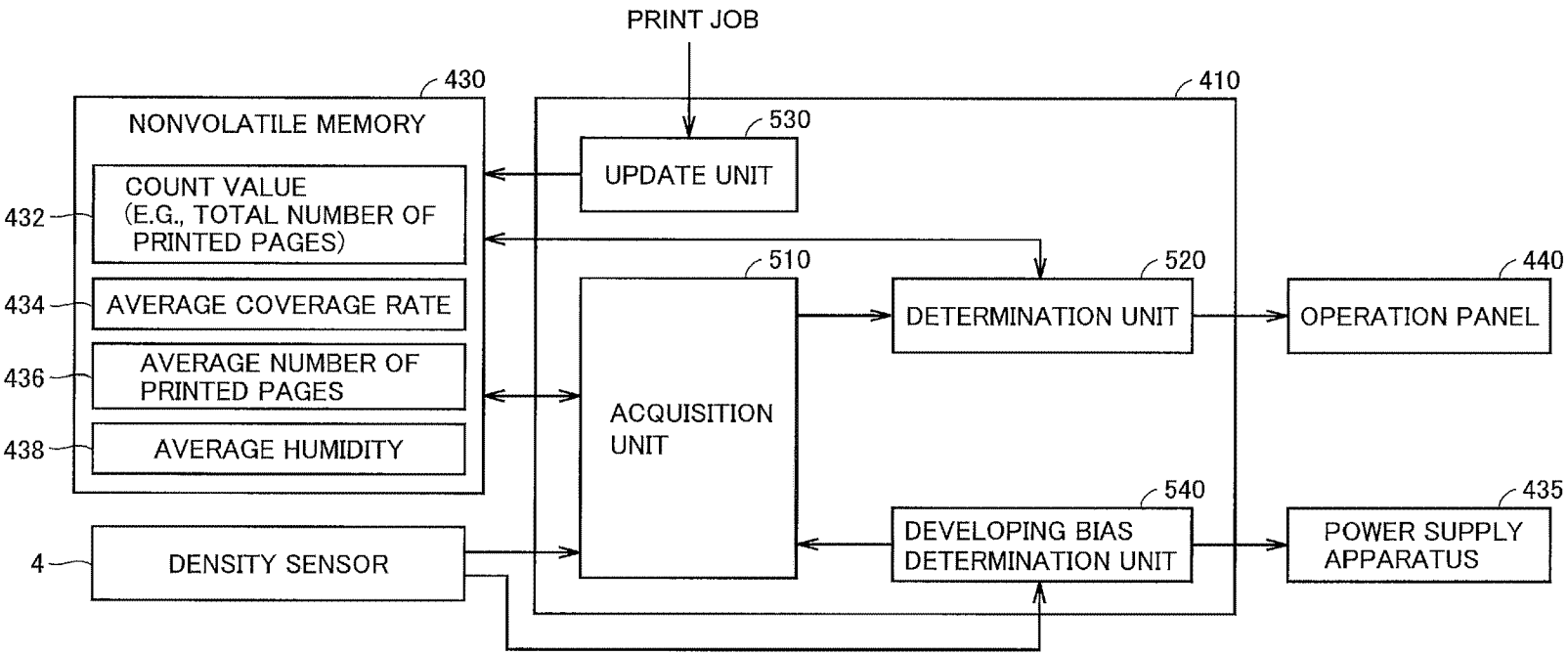
FIG. 5 shows an example of a functional configuration of a CPU.

FIG. 5 shows an example of a functional configuration of CPU 410. CPU 410 reads and executes control program 422 to thereby function as an acquisition unit 510, a determination unit 520, an update unit 530, and a developing bias determination unit 540.

Acquisition unit 510 indirectly acquires the charge amount of toner stored in developing device 22, and outputs the result of the acquisition to determination unit 520. Based on a value that is input from acquisition unit 510 to determination unit 520, determination unit 520 determines whether the usable period of cleaning blade 26Y has expired or not.

When determination unit 520 determines that the usable period of cleaning blade 26Y has expired, determination unit 520 causes operation panel 44 to display an instruction to replace cleaning blade 26Y. Recognizing this instruction, a user replaces cleaning blade 26Y.

In another aspect, unit-by-unit replacement may be performed for replacing a unit including cleaning blade 26Y and another component(s) (photoconductor 3Y for example) with a new unit. In this case, determination unit 520 causes operation panel 44 to display an instruction to replace this unit.

Based on an input print job (image data), update unit 530 updates count value 432, average coverage rate 434, average number of printed pages 436, and average humidity 438. For example, it is supposed that a monochrome print job is input to image forming apparatus 300. In this case, when the print job is completed, update unit 530 updates count value 432, average coverage rate 434, average number of printed pages 436, and average humidity 438 for black.

Developing bias determination unit 540 calculates a developing bias voltage value based on the result of detection by density sensor 4 for a patch image having a predetermined shape and tone value. Developing bias determination unit 540 outputs information indicating the calculated developing bias voltage value to power supply apparatus 435. Based on the input information, power supply apparatus 435 applies the developing bias voltage to developing roller 25.

In an aspect, acquisition unit 510 acquires the developing bias voltage value calculated by developing bias determination unit 540 for using the developing bias voltage as a toner charge amount. This is for the reason that there is a proportional relation between the developing bias voltage value and the toner charge amount as described below.

It is supposed that a potential difference between a surface potential of exposed photoconductor 3Y and a surface potential of developing roller 25Y (developing bias voltage) is ΔV, and the toner charge amount (charge amount of toner stored in developing device 22Y) is Vt. In this case, density C of a toner image is calculated by determining: potential difference ΔV/toner charge amount Vt. Developing bias determination unit 540 sets the developing bias voltage value so that density C is constant. Thus, a proportional relation holds between potential difference ΔV and toner charge amount Vt. Usually, the surface potential of exposed photoconductor 3Y is controlled so that the surface potential is constant. A proportional relation therefore holds between the developing bias voltage value and the toner charge amount.

Developing Bias Voltage

Figure 6:
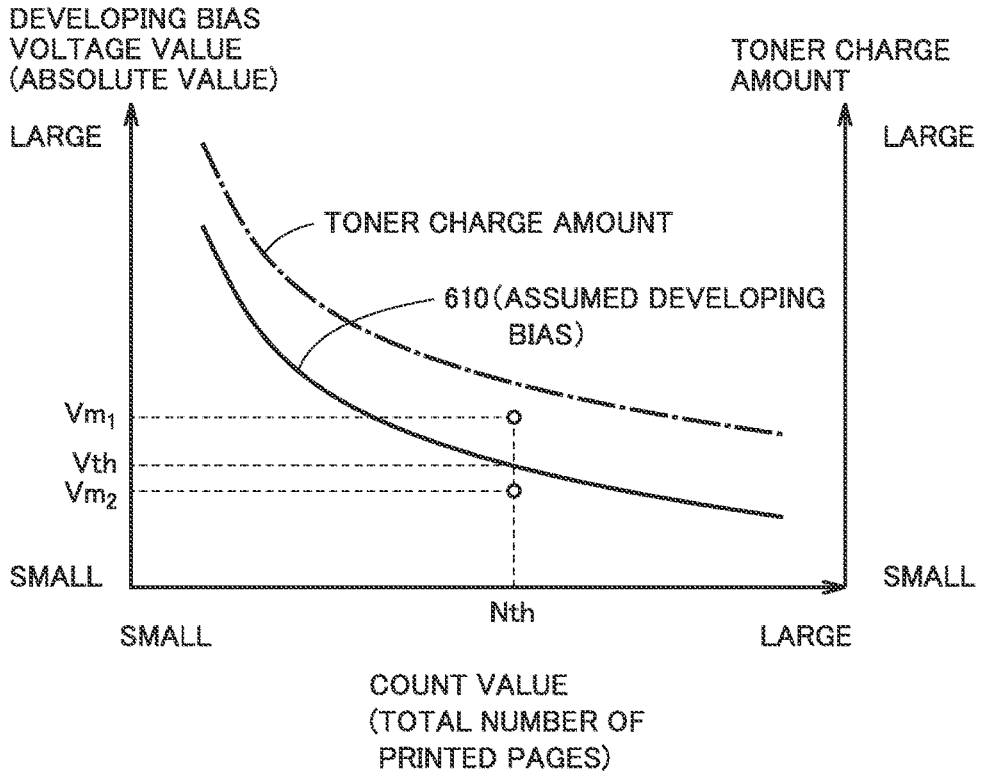
FIG. 6 is a diagram for illustrating a process for determining whether the usable period of a cleaning blade has expired, based on a developing bias voltage value regarded as a toner charge amount.

FIG. 6 is a diagram for illustrating a process for determining whether the usable period of cleaning blade 26Y has expired or not, based on a developing bias voltage regarded as a toner charge amount. The horizontal axis of FIG. 6 represents the count value (total number of printed pages, for example), the left vertical axis represents the absolute value of the developing bias voltage value, and the right vertical axis represents the toner charge amount.

A curve 610 indicated by a solid line represents the developing bias voltage value assumed based on count value 432 for yellow. In an aspect, it is supposed that a relational expression representing curve 610 is stored in nonvolatile memory 430. As count value 432 increases, the developing bias voltage value decreases. This is for the reason that the toner charge amount having a proportional relation with the developing bias voltage value decreases gradually with time, relative to the toner charge amount at the time of shipment from a factory.

In an aspect, when count value 432 reaches a predetermined value Nth, developing bias determination unit 540 calculates the developing bias voltage based on an output from density sensor 4. When count value 432 is the total number of printed pages, predetermined value Nth may be set to an assumed number of printable pages for which cleaning blade 26Y is used.

Determination unit 520 acquires, through acquisition unit 510, the result of the calculation (developing bias voltage value) of developing bias determination unit 540. Determination unit 520 further acquires assumed developing bias voltage Vth for predetermined value Nth. Developing bias voltage value Vth may be stored in nonvolatile memory 430 or calculated from the relational expression represented by curve 610.

When the developing bias voltage value calculated by developing bias determination unit 540 is $Vm_1$ that is equal to or larger than voltage value Vth, determination unit 520 determines that the usable period of cleaning blade 26Y has expired. In other words, because the toner charge amount is an assumed predetermined value or more (because remaining toner adheres to photoconductor 3Y more firmly than assumed), determination unit 520 determines that the remaining toner cannot be collected sufficiently by cleaning blade 26Y.

In contrast, when the developing bias voltage value calculated by developing bias determination unit 540 is $Vm_2$ that is less than voltage value Vth, determination unit 520 determines that cleaning blade 26Y is still usable. In other words, because the toner charge amount is less than the assumed predetermined value (because remaining toner adheres to photoconductor 3Y more weakly than assumed), determination unit 520 determines that the remaining toner can be collected sufficiently by cleaning blade 26Y. Next, with reference to FIGS. 7 and 8, a description is given of a flow of a process performed by CPU 410.

Figure 7:
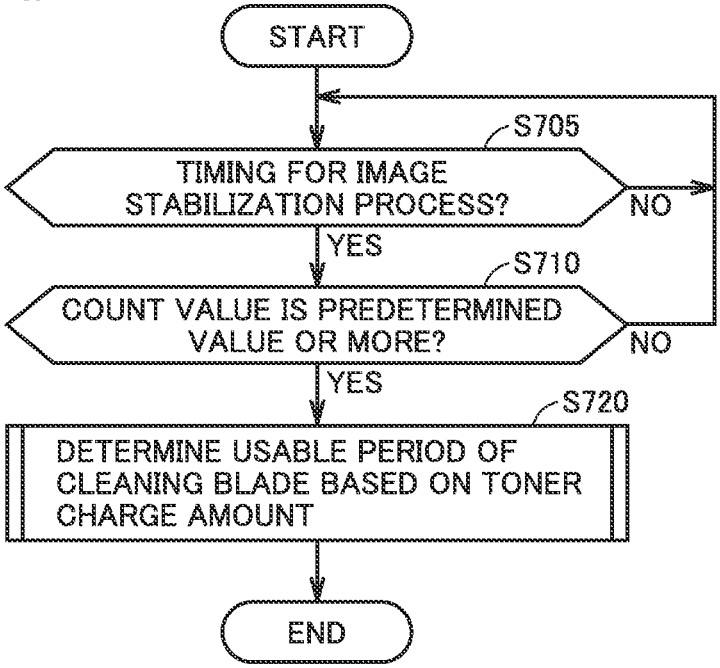
FIG. 7 is a flowchart for illustrating an example of the timing for a determination unit to perform a determination process.

FIG. 7 is a flowchart for illustrating an example of the timing of performing a determination process by determination unit 520. The processes shown in FIG. 7 and FIGS. 8 to 11, 15A, and 15B described later herein are implemented by CPU 410 reading and executing control program 422.

In step S705, CPU 410 determines whether a timing for an image stabilization process has been reached or not. The timing for the image stabilization process is set for example to the timing when image forming apparatus 300 is powered or the total number of printed pages reaches a predetermined number of pages (1000 pages for each case, for example). When the timing for the image stabilization process is reached (YES in step S705), CPU 410 proceeds to step S710. In contrast, when the timing for the image stabilization process is not reached (NO in step S705), CPU 410 returns to step S705.

The image stabilization process is a process for setting the developing bias voltage value so that the density of the toner image is constant. Specifically, under predetermined printing conditions, a predetermined patch image (halftone image, for example) is formed. Based on the density of the patch image detected by density sensor 4, developing bias determination unit 540 sets the developing bias voltage value.

In step S710, CPU 410 determines whether count value 432 is predetermined value Nth or more. When count value 432 is predetermined value Nth or more (YES in step S710), CPU 410 proceeds to step S720. When count value 432 is less than predetermined value Nth (NO in step S710), CPU 410 returns to step S705.

In step S720, CPU 410 performs a process for determining whether the usable period of cleaning blade 26Y has expired or not based on the toner charge amount (hereinafter also referred to as "determination process").

Figure 8:
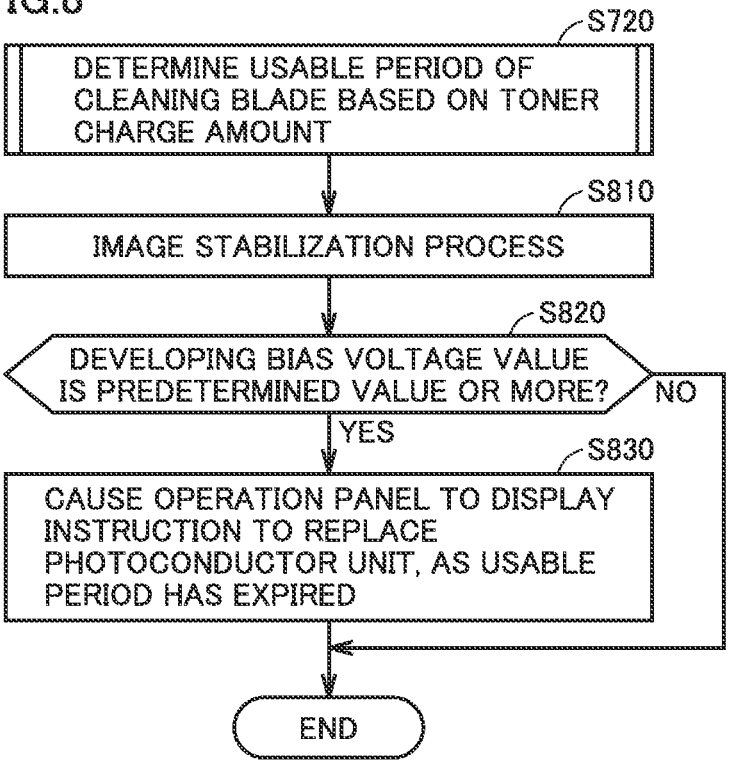
FIG. 8 is a flowchart showing the determination process in step S720 in FIG. 7.

FIG. 8 is a flowchart illustrating the determination process in step S720 in FIG. 7. In step S810, CPU 410 performs the image stabilization process. In this process, CPU 410 functions as acquisition unit 510 to acquire the developing bias voltage value proportional to the toner charge amount.

In step S820, CPU 410 functions as determination unit 520 to determine whether the acquired developing bias voltage value is predetermined value Vth or more. When the acquired developing bias voltage value is predetermined value Vth or more (YES in step S820), CPU 410 proceeds to step S830. When the acquired developing bias voltage value is less than predetermined value Vth (NO in S820), CPU 410 ends the series of steps.

In an aspect, predetermined value Vth in step S820 is set to a predetermined voltage value. In another aspect, predetermined value Vth is set to a voltage value that is calculated from the relational expression represented by curve 610 and corresponds to count value 432.

In step S830, CPU 410 causes operation panel 44 to display an instruction to replace a photoconductor unit including cleaning blade 26Y. Recognizing this instruction, a user can replace cleaning blade 26Y.

In another aspect, CPU 410 may transmit the instruction to replace cleaning blade 26Y to an external apparatus owned by a management company of image forming apparatus 300, through communication I/F 450. Then, a serviceperson can immediately replace cleaning blade 26Y.

As described above, when the developing bias voltage value is less than a predetermined value, image forming apparatus 300 in the first embodiment determines that the cleaning blade is still usable. Image forming apparatus 300 may therefore determine that the cleaning blade is still usable even after the assumed number of printable pages (predetermined value Nth) for which the cleaning blade is used is reached. In other words, image forming apparatus 300 can improve the precision in predicting the timing for replacing the cleaning blade or the unit including the cleaning blade, as compared with the conventional image forming apparatus. As a result of this, these components of the image forming apparatus can be used for a longer period as compared with the conventional image forming apparatus.

Toner Density

In the above-described example, determination unit 520 is configured to perform the determination process based on a developing bias voltage value regarded as a toner charge amount. In another aspect, determination unit 520 may perform the determination process based on the density of a patch image detected by density sensor 4.

As described above, density C of the patch image is calculated by determining: potential difference ΔV/toner charge amount Vt. In the image stabilization process, the developing bias voltage value is fixed, and therefore, potential difference ΔV is constant. In this case, density C of the toner image is inversely proportional to toner charge amount Vt. Determination unit 520 therefore determines that toner charge amount Vt is smaller as the density of the patch image detected by density sensor 4 in the image stabilization process is higher.

Figure 9:
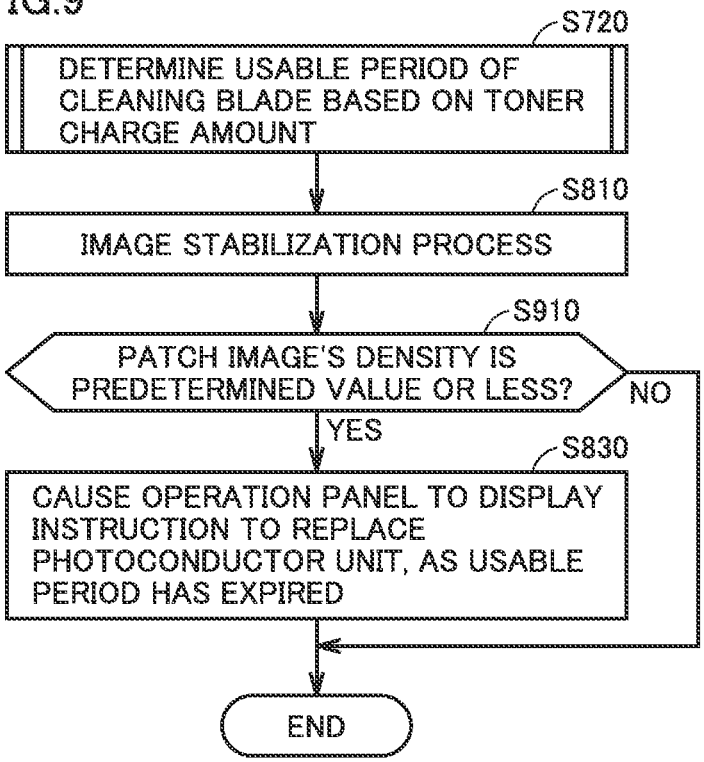
FIG. 9 is a flowchart showing the determination process in step S720 in FIG. 7 that is performed using the density of a patch image.

FIG. 9 is a flowchart showing the determination process in step S720 in FIG. 7 that is performed using the density of the patch image. In FIG. 9, the same step as the step described with reference to FIG. 8 is denoted by the same reference character, and the description of the step is not repeated.

In step S910, CPU 410 functions as determination unit 520 to determine whether the density of the patch image acquired from density sensor 4 is a predetermined density or less. When the density of the patch image is the predetermined density or less (YES in step S910), CPU 410 causes operation panel 44 to display an instruction to replace cleaning blade 26Y (S830). In contrast, when the density of the patch image is higher than the predetermined density (NO in step S910), CPU 410 ends the series of steps.

The predetermined density may be set to a density determined in advance, or set to a density that is calculated from the relational expression of the density and the toner charge amount and corresponds to count value 432.

Upper Limit of Usable Period

In the above-described example, it is determined that cleaning blade 26Y is usable as long as the developing bias voltage value is not a predetermined value or more, or as long as the density of the patch image is not a predetermined density or less. In the case, however, where unit-by-unit replacement of replacing a unit including cleaning blade 26Y and another component(s) (photoconductor 3Y for example) with a new unit is performed and the usable period of the other component has expired, cleaning blade 26Y should also be replaced together with the other component. Moreover, because cleaning blade 26Y is degraded due to wear resultant from friction against photoconductor 3Y for example, cleaning blade 26Y is not permanently usable. In view of this, according to an aspect, when the count value reaches its upper limit value at which cleaning blade 26Y should be replaced, CPU 410 informs a user of an instruction to replace cleaning blade 26Y or a unit including cleaning blade 26Y.

Figure 10:
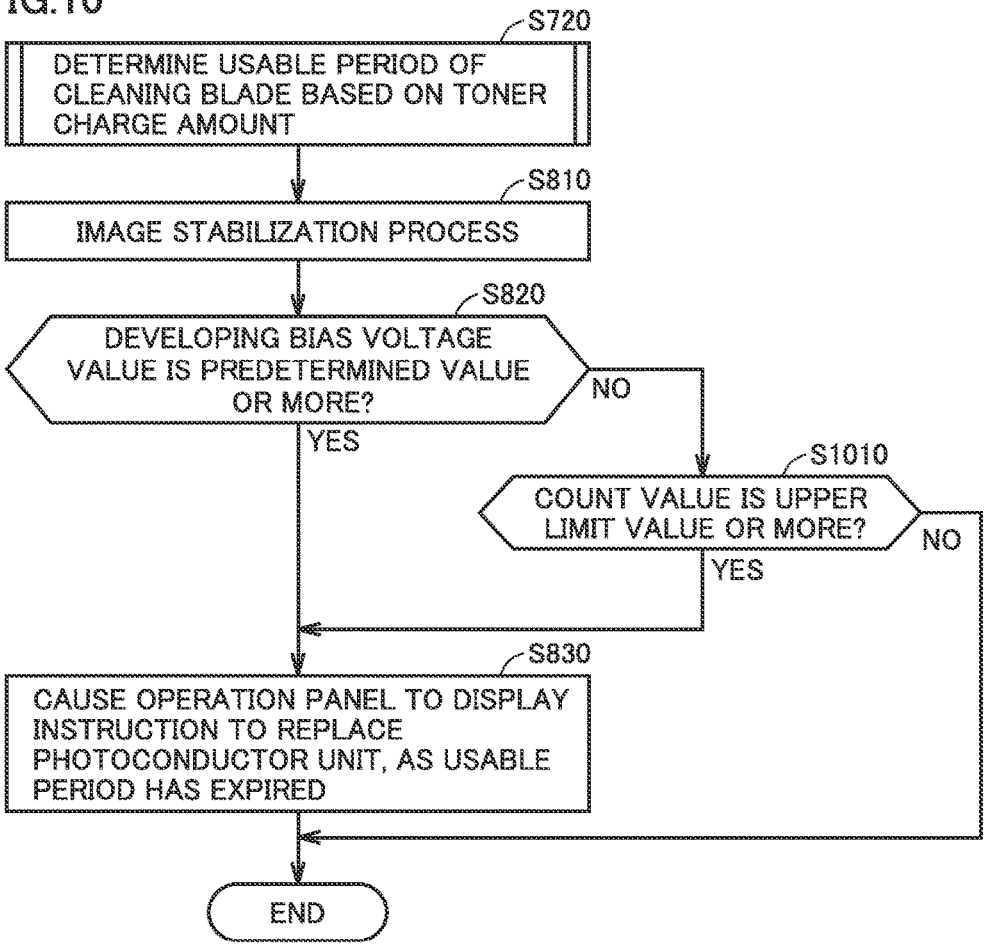
FIG. 10 is a flowchart showing the determination process in step S720 in FIG. 7, in the case where an upper limit of the usable period of a member is defined.

FIG. 10 is a flowchart showing the determination process in step S720 in FIG. 7 in the case where an upper limit of the usable period of a component is defined. In FIG. 10, the same step as the step described with reference to FIG. 8 is denoted by the same reference character, and the description of the step is not repeated.

In step S820, when the acquired developing bias voltage value is less than predetermined value Vth (NO in step S820), CPU 410 proceeds to step S1010.

In step S1010, CPU 410 functions as determination unit 520 to determine whether count value 432 for yellow is the upper limit value or more. When count value 432 is the upper limit value or more (YES in step S1010), CPU 410 causes operation panel 44 to display an instruction to replace cleaning blade 26Y or a unit including cleaning blade 26Y (S830). In contrast, when count value 432 is less than the upper limit value (NO in step S1010), CPU 410 ends the series of steps.

The upper limit value may be set to a predetermined value, or set so that the upper limit value varies depending on the condition of any component other than cleaning blade 26Y included in the unit.

Inform Remaining Usable Period

In FIGS. 8 to 10, CPU 410 is configured to end the series of steps when it determines that cleaning blade 26Y is still usable. In another aspect, CPU 410 may estimate the remaining usable period of cleaning blade 26Y and inform a user of the estimated remaining usable period.

Figure 11:
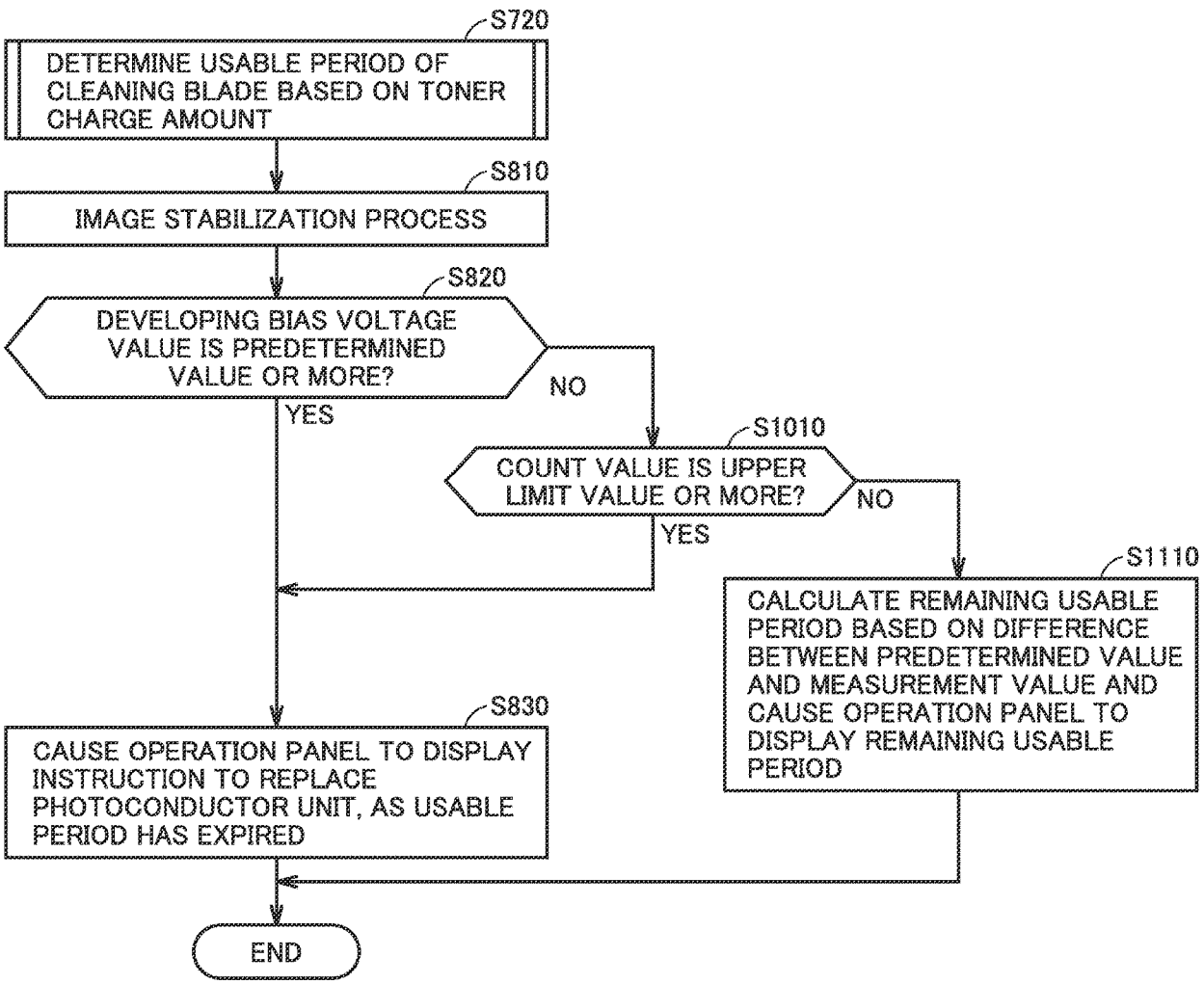
FIG. 11 is a flowchart showing the determination process in step S720 in FIG. 7, in the case where notification of the remaining usable period of a member is made.

FIG. 11 is a flowchart showing the determination process in step S720 in FIG. 7 in the case where a user is informed of the remaining usable period of a component. In FIG. 11, the same step as the step described with reference to FIG. 8 is denoted by the same reference character, and the description of the step is not repeated.

In step S1010, when count value 432 for yellow is less than the upper limit value (NO in step S1010), CPU 410 proceeds to step S1110.

In step S1110, CPU 410 calculates the difference between the acquired developing bias voltage value and predetermined value Vth. CPU 410 further calculates the remaining usable period of cleaning blade 26Y that is determined depending on the difference. More specifically, CPU 410 calculates the remaining usable period so that the remaining usable period is longer as the calculated difference is larger.

In step S820, CPU 410 determines that the developing bias voltage value is less than predetermined value Vth. In other words, in step S1110, CPU 410 determines that the usable period of cleaning blade 26Y is longer as the developing bias voltage value (toner charge amount proportional to the developing bias voltage value) is smaller.

For example, CPU 410 calculates the remaining usable period based on the relation between the difference and the remaining usable period that is stored in nonvolatile memory 430. CPU 410 causes operation panel 44 to display the calculated remaining usable period.

According to the foregoing, image forming apparatus 300 informs a user of the remaining usable period of cleaning blade 26Y or a unit including cleaning blade 26Y. The user can then recognize the remaining usable period and prepare cleaning blade Y or a unit to be replaced with the current cleaning blade or unit, and can therefore replace it smoothly.

CPU 410 may transmit the calculated remaining usable period to an external apparatus owned by a management company of image forming apparatus 300, through communication I/F 450. A serviceperson can thus perform efficient replacement.

Second Embodiment

In an image forming apparatus 300 according to a second embodiment, developing device 22 and cleaning blade 26 are configured to be replaceable independently of each other. For example, in image forming apparatus 300, cleaning blade 26 may be configured to be separately replaceable or a photoconductor unit including cleaning blade 26 and photoconductor 3 may be replaceable with another photoconductor unit.

Related Art

Figure 12:
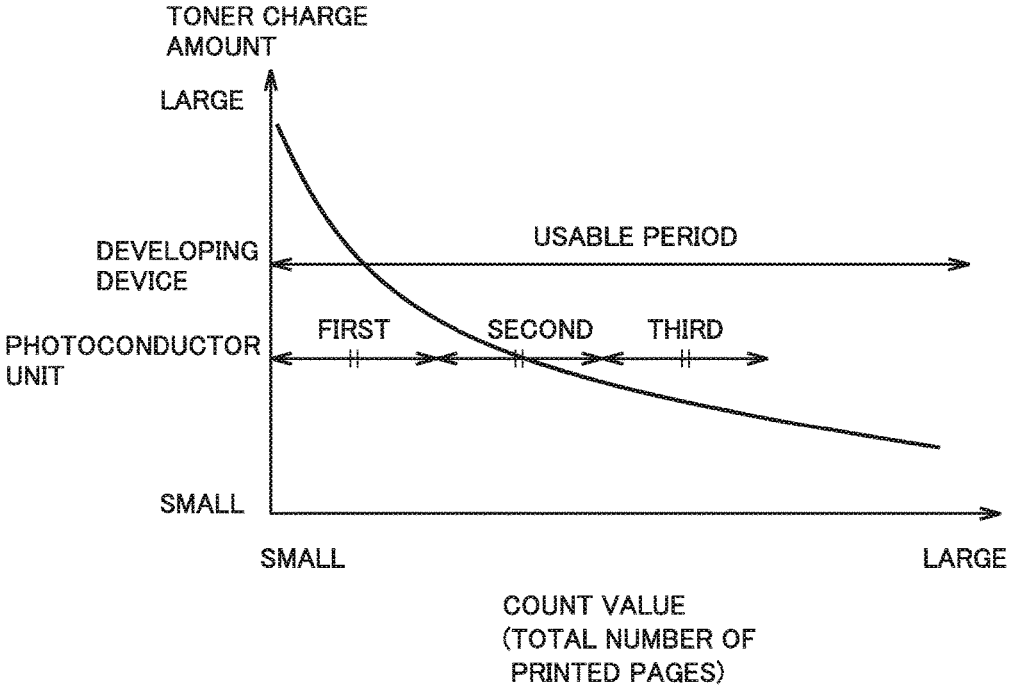
FIG. 12 is a diagram for illustrating a process for replacing a photoconductor unit in an image forming apparatus according to a related art.

FIG. 12 is a diagram for illustrating a process for replacing a photoconductor unit in an image forming apparatus according to a related art. As shown in FIG. 12, the usable period of the developing device is longer than the usable period of the photoconductor unit. A plurality of photoconductor units are therefore used while one developing device is used. The image forming apparatus according to the related art sets respective usable periods (total number of printed pages, for example) of a plurality of photoconductor units to the same period.

As shown in FIG. 12, however, the toner charge amount gradually decreases with passage of time. As described above, the ability of the cleaning blade is higher as the toner charge amount is smaller. Therefore, the usable period of a photoconductor unit to be replaced later should be set longer than the usable period of a photoconductor unit to be replaced earlier. In view of this, image forming apparatus 300 according to the second embodiment sets the usable period of the photoconductor unit in the manner shown in FIG. 13.

Overview

Figure 13:
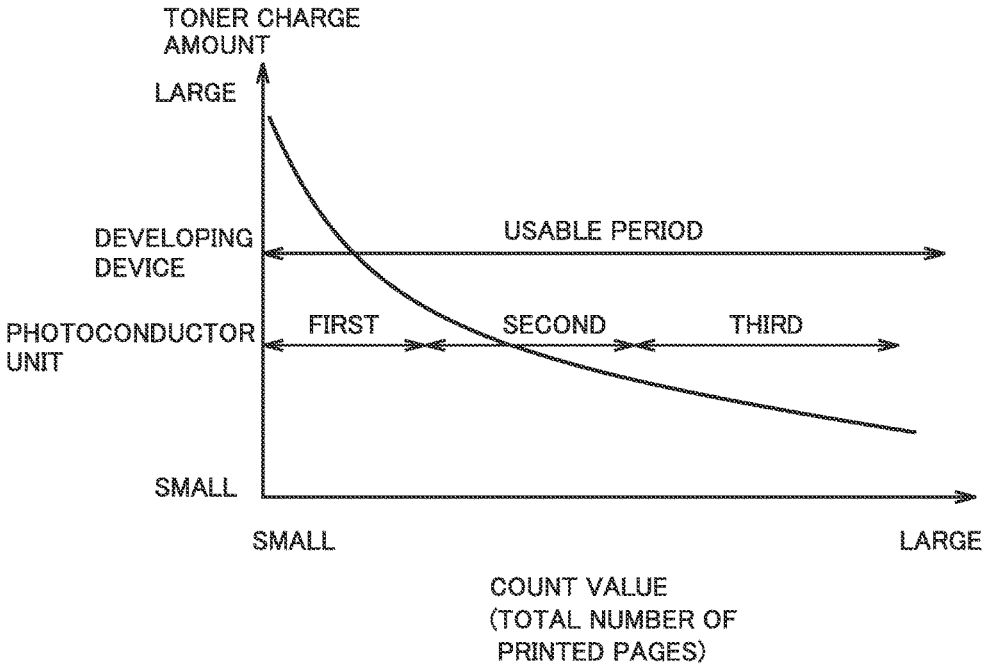
FIG. 13 is a diagram for illustrating a process for replacing a photoconductor unit in an image forming apparatus according to a second embodiment.

FIG. 13 is a diagram for illustrating a process for replacing the photoconductor unit in image forming apparatus 300 according to the second embodiment. With reference to FIG. 13, image forming apparatus 300 according to the second embodiment sets the usable period (total number of printed pages) depending on the number of photoconductor units replaced for the same developing device. More specifically, image forming apparatus 300 sets the usable period longer as the number of photoconductor units replaced for the same developing device is larger.

According to the foregoing, the photoconductor unit of image forming apparatus 300 according to the second embodiment is usable for a longer period than the photoconductor unit of the image forming apparatus according to the related art.

In the case where cleaning blade 26Y is configured to be replaceable independently of developing device 22Y and photoconductor 3Y, image forming apparatus 300 sets the usable period of cleaning blade 26Y longer as the number of cleaning blades 26Y replaced for the same developing device 22Y is larger.

For cleaning blade 27 and cleaning blade 29 as well, image forming apparatus 300 sets the usable period of these cleaning blades longer as the number of cleaning blades replaced for the same developing device 22 is larger.

Process Flow

Figure 14:
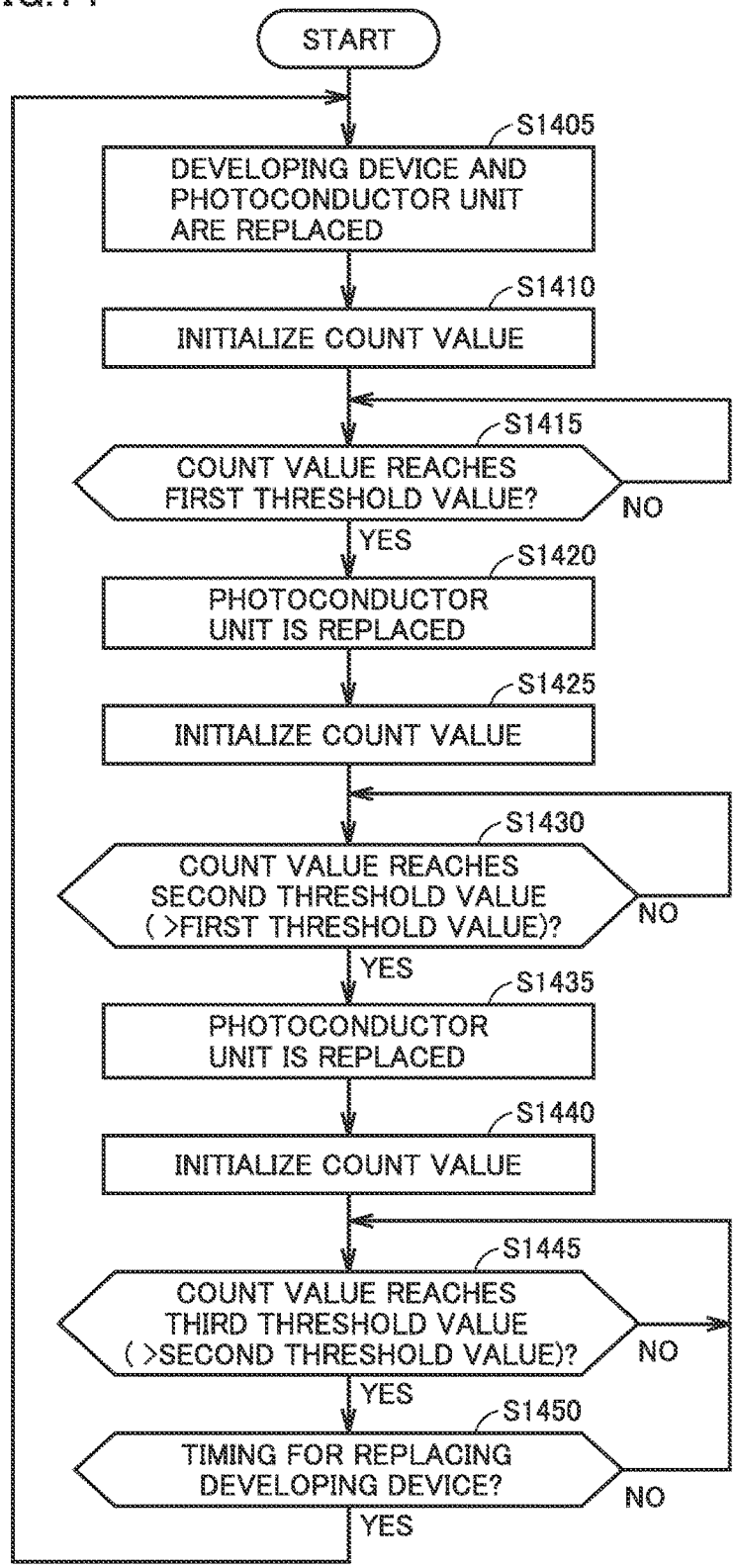
FIG. 14 is a flowchart showing a process for replacing a photoconductor unit including a cleaning blade.

FIG. 14 is a flowchart showing a process for replacing a photoconductor unit including cleaning blade 26Y. In step S1405, CPU 410 detects that a photoconductor unit including developing device 22Y and cleaning blade 26Y has been replaced. For example, based on information that is input from operation panel 44 operated by a user, CPU 410 detects that these components have been replaced. In step S1410, in response to the replacement of the photoconductor unit (cleaning blade 26Y included in the photoconductor unit), CPU 410 functions as update unit 530 to initialize count value 432 for yellow.

In step S1415, CPU 410 functions as determination unit 520 to determine whether count value 432 has reached a first threshold value or not. When count value 432 has reached the first threshold value (YES in step S1415), CPU 410 proceeds to step S1420. In contrast, when count value 432 has not reached the first threshold value (NO in step S1415), CPU 410 returns to step S1415.

In step S1420, CPU 410 causes operation panel 44 to display an instruction to replace the photoconductor unit. Following the instruction, a user replaces the photoconductor unit and inputs, to operation panel 44, the fact that the replacement is completed. Based on the information that is input from operation panel 44, CPU 410 detects that the photoconductor unit has been replaced. In step S1425, CPU 410 initializes count value 432, in response to the replacement of the photoconductor unit.

In step S1430, CPU 410 functions as determination unit 520 to determine whether count value 432 has reached a second threshold value or not. The second threshold value is set to a value larger than the first threshold value. When count value 432 has reached the second threshold value (YES in step S1430), CPU 410 proceeds to step S1435. In contrast, when count value 432 has not reached the second threshold value (NO in step S1430), CPU 410 returns to step S1430.

In step S1435, CPU 410 detects that the photoconductor unit has been replaced. In step S1440, in response to the replacement of the photoconductor unit, CPU 410 initializes count value 432.

In step S1445, CPU 410 functions as determination unit 520 to determine whether count value 432 has reached a third threshold value or not. The third threshold value is set to a value larger than the second threshold value. When count value 432 has reached the third threshold value (YES in step S1445), CPU 410 proceeds to step S1450. When count value 432 has not reached the third threshold value (NO in step S1445), CPU 410 returns to step S1445.

In step S1450, CPU 410 determines whether the time for replacement of developing device 22Y has been reached or not. For example, when the total number of printed pages by means of developing device 22Y has reached a predetermined number of pages, CPU 410 determines that the time for replacement of developing device 22Y has been reached. When the time for replacement of developing device 22Y has been reached (YES in step S1450), CPU 410 returns to step S1405. In contrast, when the time for replacement of developing device 22Y has not been reached (NO in step S1450), CPU 410 returns to step S1445.

In the example shown in FIG. 14, three cleaning blades 26Y are to be used for one developing device 22Y. The number of cleaning blades, however, is not limited to three, as long as a plurality of cleaning blades 26 may be used for one developing device 22.

According to the foregoing, image forming apparatus 300 in the second embodiment sets the usable period of the cleaning blade longer as the number of cleaning blades replaced for the same developing device is larger. Image forming apparatus 300 in the second embodiment can therefore set the usable period of the cleaning blade based on the toner charge amount with higher accuracy than the conventional image forming apparatus. Therefore, the cleaning blade and a unit including the cleaning blade in this image forming apparatus 300 are usable for a longer period as compared with those in the conventional image forming apparatus.

Image forming apparatus 300 is also configured so that the last photoconductor unit (cleaning blade included in the last photoconductor unit) for the same developing device is replaced together with the developing device (S1445, S1450). Thus, this image forming apparatus 300 can set the usable period of the cleaning blade through a simple process. Moreover, image forming apparatus 300 can prevent the toner charge amount to vary significantly while the same cleaning blade 26 is used. As a result of this, this image forming apparatus 300 can suppress generation of image defects due to significant deterioration of the ability of cleaning blade 26 in operation.

Determine Usable Period in Consideration of Average Coverage Rate

Figure 15A:
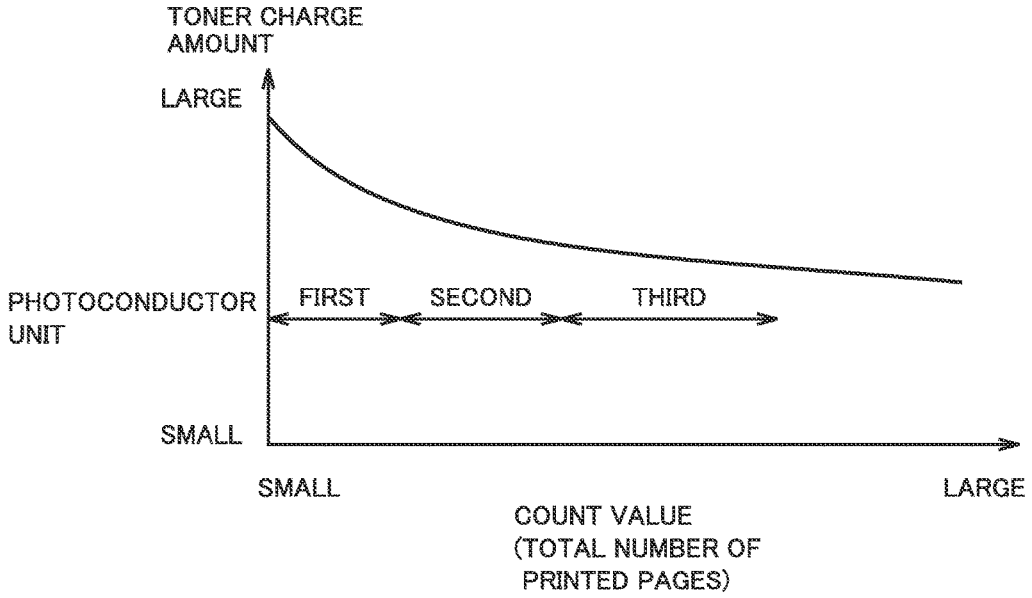
FIG. 15A is a diagram showing usable periods of photoconductor units in the case where the average coverage rate is low.
Figure 15B:
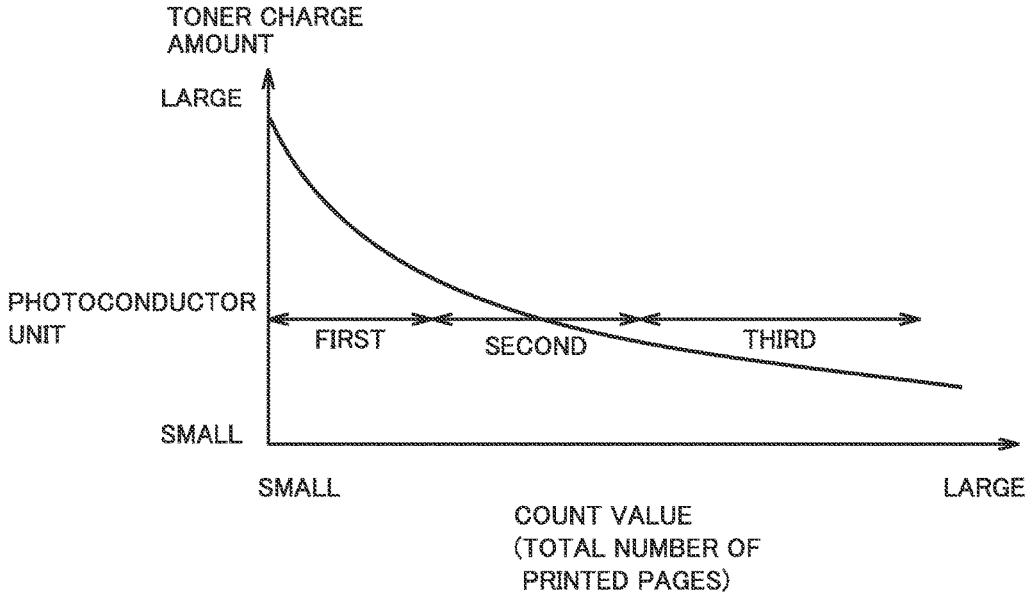
FIG. 15B is a diagram showing usable periods of photoconductor units in the case where the average coverage rate is high.

FIG. 15A shows usable periods of photoconductor units in the case where the average coverage rate is low. FIG. 15B shows usable periods of photoconductor units in the case where the average coverage rate is high.

In the following, a description is given of a process for setting the usable period of cleaning blade 26 in consideration of the average coverage rate. When average coverage rate 434 of yellow is low, the speed at which the toner stored in developing device 22Y is consumed is slow. In other words, the time for which the toner stays in developing device 22Y is long.

Developing device 22Y contains carriers of a magnetic material such as ferrite. The toner is electrically charged through friction against carriers while the toner stays in developing device 22Y. When average coverage rate 434 is low, the rate at which the toner charge amount decreases with increase of the count value is low.

In contrast, when average coverage rate 434 of yellow is high, the speed at which the toner stored in developing device 22Y is consumed is high. In other words, the time for which the toner stays in developing device 22Y is short. Therefore, when average coverage rate 434 is high, the rate at which the toner charge amount decreases with increase of the count value is high.

Therefore, as average coverage rate 434 of yellow is higher, image forming apparatus 300 may set the usable period of cleaning blade 26Y (photoconductor unit including cleaning blade 26Y and photoconductor 3Y) longer. For example, image forming apparatus 300 sets the first, second, and third threshold values described in connection with FIG. 14 to larger values as average coverage rate 434 of yellow is higher.

According to the foregoing, image forming apparatus 300 can further improve the precision in predicting the timing for replacing the cleaning blade, in consideration of the average coverage rate that influences the toner charge amount. As a result of this, the cleaning blade or the unit including the cleaning blade is usable for a longer period as compared with the conventional image forming apparatus.

Determine Usable Period in Consideration of Average Number of Printed Pages

In another aspect, image forming apparatus 300 may be configured to set the usable period of the cleaning blade based on average number of printed pages 436.

When average number of printed pages 436 for yellow is small, the speed at which the toner stored in developing device 22Y is consumed is slow. In other words, the time for which the toner stays in developing device 22Y is long. In contrast, when average number of printed pages 436 for yellow is large, the speed at which the toner stored in developing device 22Y is consumed is high. In other words, the time for which the toner stays in developing device 22Y is short.

Therefore, image forming apparatus 300 may set the first, second, and third threshold values in FIG. 14 so that the usable period of cleaning blade 26Y (photoconductor unit including cleaning blade 26Y and photoconductor unit 3Y) is longer as average number of printed pages 436 for yellow is larger.

Image forming apparatus 300 configured in this manner can further improve the precision in predicting the timing for replacing the cleaning blade, in consideration of the average number of printed pages that influences the toner charge amount. As a result of this, the cleaning blade or a unit including the cleaning blade is usable for a longer period as compared with the conventional image forming apparatus.

Determine Usable Period in Consideration of Average Humidity

The toner charge amount varies depending on the humidity. More specifically, as the humidity is higher, the amount by which the toner charge amount decreases with passage of time increases. In view of this, in an aspect, image forming apparatus 300 may set the first, second, and third threshold values so that the usable period of the cleaning blade is longer as average humidity 438 is higher.

Image forming apparatus 300 configured in this manner can further improve the precision in predicting the timing for replacing the cleaning blade, in consideration of the humidity that influences the toner charge amount. As a result of this, the cleaning blade or a unit including the cleaning blade is usable for a longer period as compared with the conventional image forming apparatus.

Pressing Force for Cleaning Blade

Figure 16:
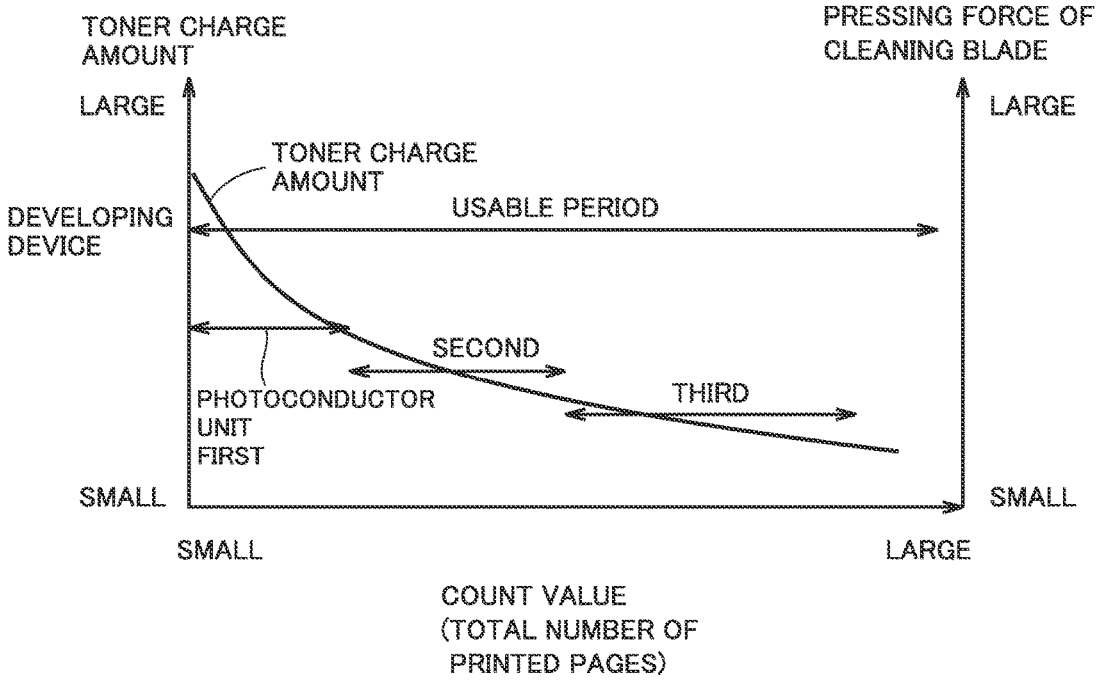
FIG. 16 is a diagram for illustrating a process for setting the pressing force for a cleaning blade in the image forming apparatus according to the second embodiment.

FIG. 16 is a diagram for illustrating the process for setting the pressing force for cleaning blade 26 in image forming apparatus 300 according to the second embodiment. In FIG. 16, the horizontal axis represents the count value, the left vertical axis represents the toner charge amount, and the right vertical axis represents the pressure (pressing force) applied by a pressing mechanism (not shown) for pressing cleaning blade 26 against photoconductor 3.

As the toner charge amount is larger, the toner adheres to photoconductor 3 more strongly. Generally, the pressing force for cleaning blade 26 is set strong so that toner can be collected sufficiently even when the toner charge amount is large. The pressing force for cleaning blade 26 is set to the same force even when the number of cleaning blades 26 replaced for the same developing device increases. However, the toner charge amount decreases gradually with passage of time. In view of this, image forming apparatus 300 controls the pressing mechanism so that the pressing force for cleaning blade 26 is smaller as the number of photoconductor units (cleaning blades 26 included in the photoconductor units) replaced for the same developing device is larger.

Image forming apparatus 300 configured in this manner can suppress deterioration of cleaning blade 26 due to wear, by making the pressing force for cleaning blade 26 smaller. This image forming apparatus 300 can therefore further increase the usable period of cleaning blade 26.

Image forming apparatus 300 may also control the pressing mechanism so that the pressing force for cleaning blade 27 and cleaning blade 29 is smaller as the number of cleaning blades replaced for the same developing device is larger.

Third Embodiment

In the foregoing example, image forming apparatus 300 is configured to indirectly acquire the toner charge amount by acquiring the developing bias voltage value or the patch image density, for example. An image forming apparatus 1700 according to a third embodiment directly acquires this toner charge amount.

Figure 17:
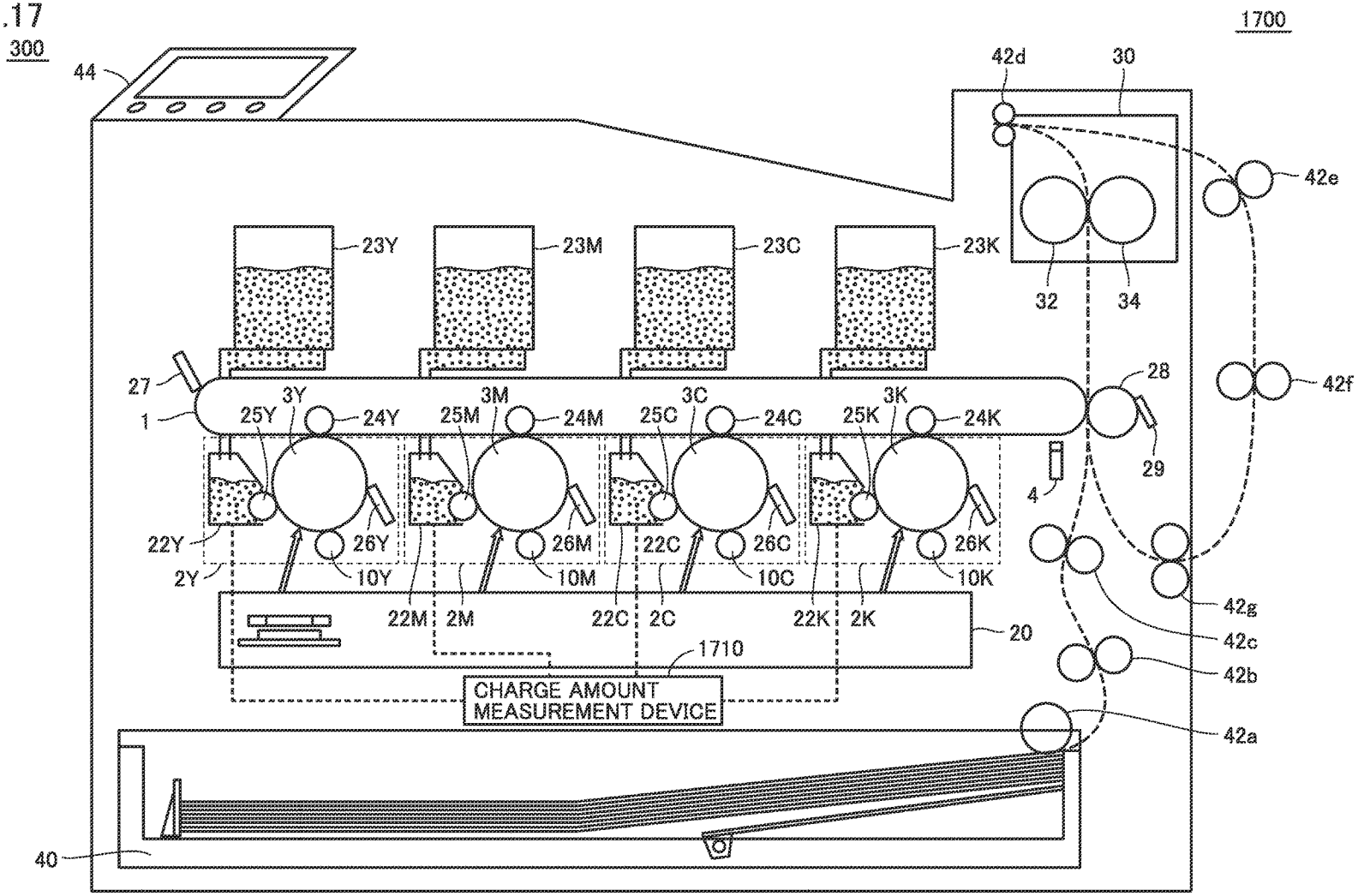
FIG. 17 is a diagram for illustrating an example of a configuration of an image forming apparatus according to a third embodiment.

FIG. 17 is a diagram for illustrating an example of a configuration of image forming apparatus 1700 according to the third embodiment. Image forming apparatus 1700 differs from image forming apparatus 300 described above with reference to FIG. 3 in that the former includes a charge amount measurement device 1710.

Charge amount measurement device 1710 is connected to each of developing devices 22Y, 22M, 22C, 22K and configured to be capable of measuring the charge amount of toner stored in each of developing devices 22Y, 22M, 22C, 22K. Charge amount measurement device 1710 measures the charge amount of toner based on the blow-off method, the suction method, the DC field method, or another known method for measuring the charge amount of powder. Charge amount measurement device 1710 measures the toner charge amount of each color and outputs the result of the measurement to CPU 410.

Figure 18:
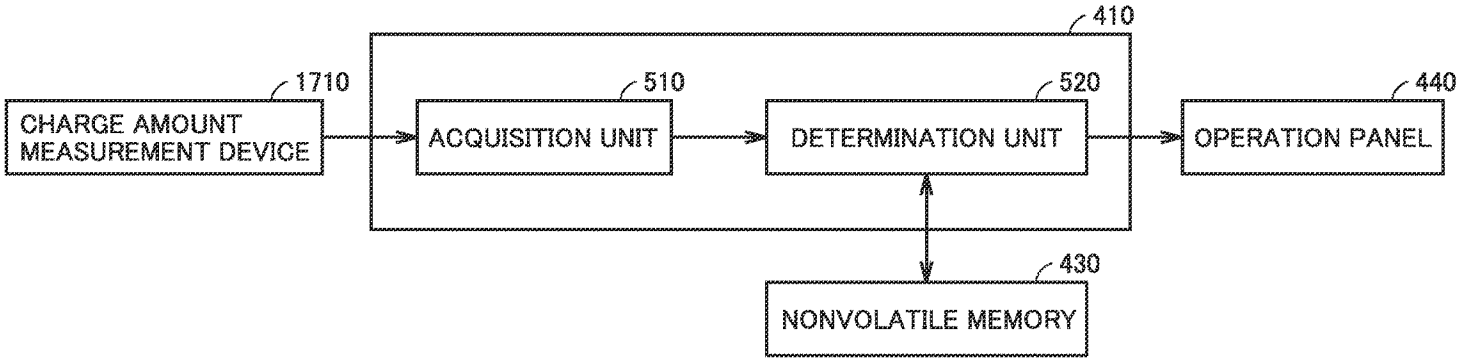
FIG. 18 shows an example of a functional configuration of a CPU according to the third embodiment.

FIG. 18 shows an example of a functional configuration of CPU 410 according to the third embodiment. As shown in FIG. 18, acquisition unit 510 acquires the toner charge amount of yellow from charge amount measurement device 1710, and outputs the result of the acquisition to determination unit 520. When the acquired toner charge amount is a predetermined charge amount or more, determination unit 520 determines that the usable period of cleaning blade 26 has expired. The predetermined charge amount may be stored in nonvolatile memory 430, or calculated from a relational expression representing the relation between count value 432 and the toner charge amount.

Image forming apparatus 1700 in the third embodiment configured in the above-described manner can acquire the toner charge amount accurately. In other words, image forming apparatus 1700 can determine the timing for replacing the cleaning blade more accurately. Therefore, the cleaning blade of image forming apparatus 1700 is usable for a still longer period. Moreover, image forming apparatus 1700 can suppress occurrence of image defects due to the fact that an estimated toner charge amount is larger than the actual charge amount.

Fourth Embodiment

Figure 19:
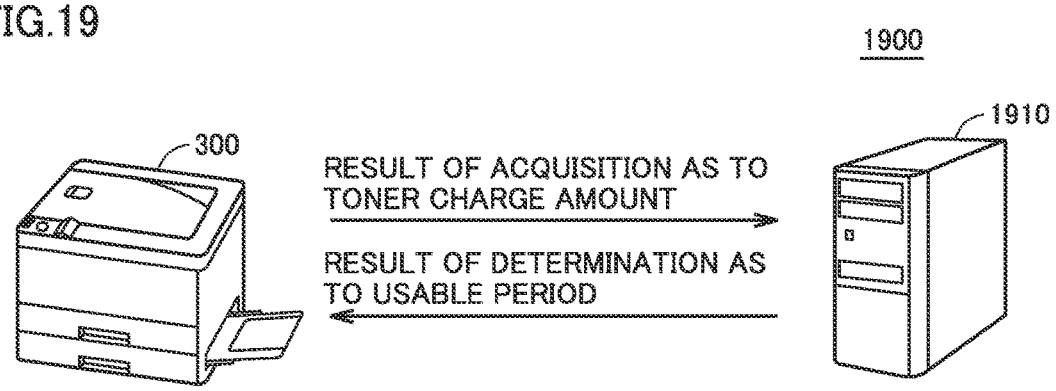
FIG. 19 shows an example of a configuration of an image forming system according to a fourth embodiment.

In the above-described example, the image forming apparatus is configured to determine whether the usable period of cleaning blade 26Y has expired or not. In another aspect, a server apparatus configured to be capable of communicating with the image forming apparatus may be configured to make this determination FIG. 19 shows an example of a configuration of an image forming system 1900 according to a fourth embodiment. Image forming system 1900 includes an image forming apparatus 300 and a server apparatus 1910. Image forming apparatus 300 and server apparatus 1910 are configured to be capable of communicating with each other. Server apparatus 1910 may be an apparatus owned by a manager of image forming apparatus 300.

Image forming apparatus 300 transmits the result of acquisition of the toner charge amount acquired by acquisition unit 510 to server apparatus 1910 through communication I/F 450. The result of acquisition of the toner charge amount includes the developing bias voltage value for developing device 22Y, the density of a yellow patch image, count value 432 of yellow, average coverage rate 434, average number of printed pages 436, and average humidity 438, for example Based on the result of acquisition regarding the toner charge amount acquired from image forming apparatus 300, server apparatus 1910 transmits, to image forming apparatus 300, information such as the result of the determination as to whether the usable period of cleaning blade 26Y or a unit including cleaning blade 26Y has expired or not, and the remaining usable period of cleaning blade 26Y, for example. Image forming apparatus 300 causes operation panel 44 to display the information received from server apparatus 1910.

Image forming system 1900 configured in this manner can more accurately determine the timing for replacing cleaning blade 26Y based on the yellow toner charge amount. Accordingly, cleaning blade 26Y or a unit including cleaning blade 26Y used for image forming system 1900 is usable for a longer period than the one in the conventional image forming system.

Regarding the first to fourth embodiments, the above description is given of the usable period of cleaning blade 26Y for the sake of facilitating understanding of the description. The processes for determining the usable periods of cleaning blades 26 for other colors (magenta, cyan, black) are also performed in a similar manner For both cleaning blades 27 and 29 as well, the process for determining the usable period of the cleaning blade is performed using the toner charge amount acquired indirectly or directly by acquisition unit 510, similarly to the process for cleaning blade 26. It should be noted that CPU 410 performs the process for determining the usable period of cleaning blades 27 and 29 using the largest toner charge amount among respective toner charge amounts of the colors, in order to suppress occurrence of image defects.

According to the above description, the processes are implemented by CPU 410 or server apparatus 1910. The processes, however, are not limited to this. The processes may be implemented by at least one semiconductor integrated circuit such as processor, at least one ASIC (Application Specific Integrated Circuit), at least one DSP (Digital Signal Processor), at lest one FPGA (Field Programmable Gate Array), and/or another circuit having an arithmetic operation capability.

These circuits may perform the above-described processes by reading one or more instructions from at least one tangible readable medium.

Such a medium may take any form such as magnetic medium (hard disk, for example), optical medium (compact disc (CD), DVD, for example), any type of memory such as volatile memory or nonvolatile memory, for example. The medium, however, is not limited to these forms.

The volatile memory may include DRAM (Dynamic Random Access Memory) and SRAM (Static Random Access Memory). The nonvolatile memory may include ROM and NVRAM. The semiconductor memory may form, together with at least one processor, a part of a semiconductor circuit.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

a rotatable body;

a cleaner to remove developer adhered to the rotatable body; and a controller configured to determine that a usable period of the cleaner is longer as a charge amount of the developer is smaller.

2. The image forming apparatus according to claim 1, further comprising:

a developing device to develop an electrostatic latent image formed on a photoconductor by the developer; and a density sensor to detect a density of a patch image developed by the developing device, wherein the controller is configured to determine that the charge amount of the developer is smaller as the density of the patch image detected by the density sensor is higher.

3. The image forming apparatus according to claim 1, further comprising:

a developing device to develop an electrostatic latent image formed on a photoconductor by the developer; and a density sensor to detect a density of a patch image developed by the developing device, wherein the controller is configured to determine that the charge amount of the developer is smaller as a developing bias applied to the developing device is smaller, wherein the developing bias is set based on the density of the patch image detected by the density sensor.

4. The image forming apparatus according to claim 1, wherein the controller is configured to determine that the usable period of the cleaner has expired, when the charge amount of the developer is larger than a predetermined value.

5. The image forming apparatus according to claim 1, wherein the controller is configured to determine the usable period of the cleaner after a count value reaches a predetermined value, wherein the count value is incremented as printing is performed, and the count value is initialized when the cleaner is replaced.

6. The image forming apparatus according to claim 5, further comprising:

a developing device to develop an electrostatic latent image formed on a photoconductor by the developer; and a density sensor to detect a density of a patch image developed by the developing device, wherein the controller is configured to determine that the usable period of the cleaner has expired, when the density of the patch image detected by the density sensor is a predetermined value or less.

7. The image forming apparatus according to claim 5, further comprising:

a developing device to develop an electrostatic latent image formed on a photoconductor by the developer; and a density sensor to detect a density of a patch image developed by the developing device, wherein the controller is configured to determine that the usable period of the cleaner has expired, when a developing bias applied to the developing device is a predetermined value or more, wherein the developing bias is set based on the density of the patch image detected by the density sensor.

8. The image forming apparatus according to claim 1, further comprising a developing device to develop an electrostatic latent image formed on a photoconductor by the developer, wherein the cleaner is replaceable independently of the developing device, and the controller is configured to determine that the usable period of the cleaner is longer as the number of the cleaners replaced for the same developing device is larger.

9. The image forming apparatus according to claim 8, wherein the controller is configured to set a pressure smaller as the number of the cleaners replaced for the same developing device is larger, wherein the pressure is applied to press the cleaner against the rotatable body.

10. The image forming apparatus according to claim 8, wherein the controller is configured to determine that the usable period of the cleaner has expired, when a count value reaches a predetermined value, wherein the count value is incremented as printing is performed, the predetermined value is set larger as the number of the cleaners replaced for the same developing device is larger, and the count value is initialized when the cleaner is replaced.

11. The image forming apparatus according to claim 10, wherein the controller is configured to set the predetermined value larger as a coverage rate is higher.

12. The image forming apparatus according to claim 10, wherein the controller is configured to set the predetermined value larger as an average value of the number of pages printed per print job is larger.

13. The image forming apparatus according to claim 10, wherein the controller is configured to determine that the usable period of the cleaner has expired, when the count value reaches the predetermined value and the controller determines that a usable period of the developing device has expired.

14. The image forming apparatus according to claim 1, wherein the rotatable body includes at least one of a photoconductor, an intermediate transfer belt, or a secondary transfer roller.

15. An image forming system comprising an image forming apparatus and a server apparatus, the image forming apparatus comprising:

a rotatable body;

a cleaner to remove developer adhered to the rotatable body;

an acquisition unit to acquire a charge amount of the developer; and a communication interface to transmit a result of acquisition by the acquisition unit to the server apparatus, the server apparatus being configured to determine that a usable period of the cleaner is longer as the charge amount of the developer is smaller, based on the result of acquisition.

16. A method for determining a usable period of a cleaner used for an image forming apparatus, the method comprising:

acquiring a charge amount of developer used for the image forming apparatus; and determining that the usable period of the cleaner is longer as the acquired charge amount of the developer is smaller.

17. A non-transitory computer-readable recording medium storing a determination program for determining a usable period of a cleaner used for an image forming apparatus, the determination program causing a computer to perform:

acquiring a charge amount of developer used for the image forming apparatus; and determining that the usable period of the cleaner is longer as the acquired charge amount of the developer is smaller.

* * * * *